US009466302B2

(12) United States Patent
Sen et al.

(10) Patent No.: US 9,466,302 B2
(45) Date of Patent: Oct. 11, 2016

(54) CODING OF SPHERICAL HARMONIC COEFFICIENTS

(71) Applicant: QUALCOMM Incorporated, San Diego, CA (US)

(72) Inventors: Dipanjan Sen, San Diego, CA (US); Nils Günther Peters, San Diego, CA (US); Martin James Morrell, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/479,752

(22) Filed: Sep. 8, 2014

(65) Prior Publication Data

US 2015/0071447 A1 Mar. 12, 2015

Related U.S. Application Data

(60) Provisional application No. 61/875,841, filed on Sep. 10, 2013.

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ..... G10L 19/008; H04S 2420/01; H04S 2420/11; H04S 2400/01; H04S 2400/15
USPC ..... 381/22, 23; 704/500
See application file for complete search history.

(56) References Cited

U.S. PATENT DOCUMENTS

2012/0155653 A1* 6/2012 Jax ..... G10L 19/008 381/22
2012/0314878 A1* 12/2012 Daniel ..... G10L 19/20 381/23

FOREIGN PATENT DOCUMENTS

EP 2469741 A1 6/2012
WO WO 2009067741 A1 * 6/2009 ..... G10L 19/008

OTHER PUBLICATIONS

Kirill Sakhnov Et al.: "Dynamical Energy-Based Speech/Silence Detector for Speech Enhancement Applications", Proceedings of the world Congress on Engineering WCE 2009, Jul. 3, 2009.*
International Search Report and Written Opinion from International Application No. PCT/US2014/054711, dated Dec. 5, 2014, 13 pp.
Response to Written Opinion dated Dec. 5, 2014, from International Application No. PCT/US2014/054711, filed on Jul. 10, 2015, 8 pp.
Second Written Opinion from International Application No. PCT/US2014/054711, dated Sep. 2, 2015, 7 pp.
International Preliminary Report on Patentability from International Application No. PCT/US2014/054711, dated Dec. 2, 2015, 9 pp.

* cited by examiner

*Primary Examiner* — Vivian Chin
*Assistant Examiner* — Ammar Hamid
(74) *Attorney, Agent, or Firm* — Shumaker & Sieffert, P.A.

(57) ABSTRACT

In general, techniques are described for coding of spherical harmonic coefficients representative of a three dimensional soundfield. A device comprising a memory and one or more processors may be configured to perform the techniques. The memory may be configured to store a plurality of spherical harmonic coefficients. The one or more processors may be configured to perform an energy analysis with respect to the plurality of spherical harmonic coefficients to determine a reduced version of the plurality of spherical harmonic coefficients.

21 Claims, 12 Drawing Sheets

CODING OF SPHERICAL HARMONIC COEFFICIENTS

This application claims the benefit of U.S. Provisional Application No. 61/875,841, filed 10 Sep. 2013.

TECHNICAL FIELD

The invention relates to audio data and, more specifically, coding of audio data.

BACKGROUND

A higher order ambisonics (HOA) signal (often represented by a plurality of spherical harmonic coefficients (SHC) or other hierarchical elements) is a three-dimensional representation of a soundfield. This HOA or SHC representation may represent this soundfield in a manner that is independent of the local speaker geometry used to playback a multi-channel audio signal rendered from this SHC signal. This SHC signal may also facilitate backwards compatibility as this SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for coding of spherical harmonic coefficients.

In one aspect, a method of compressing multi-channel audio data comprises performing an energy analysis with respect to a plurality of spherical harmonic coefficients to determine a reduced version of the plurality of spherical harmonic coefficients.

In another aspect, a device comprises one or more processors configured to perform an energy analysis with respect to a plurality of spherical harmonic coefficients to determine a reduced version of the plurality of spherical harmonic coefficients.

In another aspect, a device comprises means for performing an energy analysis with respect to a plurality of spherical harmonic coefficients to determine a reduced version of the plurality of spherical harmonic coefficients.

In another aspect, a non-transitory computer-readable storage medium has stored thereon instructions that, when executed, cause one or more processors to perform an energy analysis with respect to a plurality of spherical harmonic coefficients to determine a reduced version of the plurality of spherical harmonic coefficients.

In another aspect, a method of compressing audio data, the method comprises performing an energy analysis with respect to a plurality of spherical harmonic coefficients to determine at least one energy volume, wherein at least one of the plurality of spherical harmonic coefficients has an order greater than one, dynamically determining at least one threshold based on the plurality of the spherical harmonic coefficients, applying the dynamically determined at least one threshold to the at least one energy volume to generate a reduced version of the plurality of spherical harmonic coefficients, and generating a bitstream based on the reduced version of the plurality of spherical harmonic coefficients.

In another aspect, a device comprises one or more processors configured to perform an energy analysis with respect to a plurality of spherical harmonic coefficients to determine at least one energy volume, wherein at least one of the plurality of spherical harmonic coefficients has an order greater than one, dynamically determine at least one threshold based on the plurality of the spherical harmonic coefficients, apply the dynamically determined at least one threshold to the at least one energy volume to generate a reduced version of the plurality of spherical harmonic, and generate a bitstream based on the reduced version of the plurality of spherical harmonic coefficients.

In another aspect, a device comprises means for performing an energy analysis with respect to a plurality of spherical harmonic coefficients to determine at least one energy volume, wherein at least one of the plurality of spherical harmonic coefficients has an order greater than one, means for dynamically determining at least one threshold based on the plurality of the spherical harmonic coefficients, means for applying the dynamically determined at least one threshold to the at least one energy volume to generate a reduced version of the plurality of spherical harmonic coefficients, and means for generating a bitstream based on the reduced version of the plurality of spherical harmonic coefficients.

In another aspect, a non-transitory computer-readable storage medium has stored thereon instructions that, when executed, cause one or more processors to perform an energy analysis with respect to a plurality of spherical harmonic coefficients to determine at least one energy volume, wherein at least one of the plurality of spherical harmonic coefficients has an order greater than one, dynamically determine at least one threshold based on the plurality of the spherical harmonic coefficients, apply the dynamically determined at least one threshold to the at least one energy volume to generate a reduced version of the plurality of spherical harmonic coefficients, and generate a bitstream based on the reduced version of the plurality of spherical harmonic coefficients.

In another aspect, a method of compressing audio data comprises for a sliding window of time, dynamically determining a plurality of thresholds for the audio data that includes samples of spherical harmonic coefficients, and applying the dynamically determined thresholds to the spherical harmonic coefficients for the sliding window of time so as to generate a reduced set of the spherical harmonic coefficients.

In another aspect, a device comprises one or more processor configured to, for a sliding window of time, dynamically determine a plurality of thresholds for the audio data that includes samples of spherical harmonic coefficients, and apply the dynamically determined thresholds to the spherical harmonic coefficients for the sliding window of time so as to generate a reduced set of the spherical harmonic coefficients.

In another aspect, a device comprises means for dynamically determining, for a sliding window of time, a plurality of thresholds for the audio data that includes samples of spherical harmonic coefficients, means for applying the dynamically determined thresholds to the spherical harmonic coefficients for the sliding window of time so as to generate a reduced set of the spherical harmonic coefficients.

In another aspect, a non-transitory computer-readable storage medium has stored thereon instructions that, when executed, cause one or more processors to, for a sliding window of time, dynamically determine a plurality of thresholds for the audio data that includes samples of spherical harmonic coefficients, and apply the dynamically determined thresholds to the spherical harmonic coefficients for the sliding window of time so as to generate a reduced set of the spherical harmonic coefficients.

In another aspect, a method of compressing audio data comprises applying a plurality of thresholds dynamically determined on a per order basis to audio data that includes samples of spherical harmonic coefficients a plurality of spherical harmonic coefficients in order to generate a reduced set of the spherical harmonic coefficients.

In another aspect, a device comprises one or more processor configured to apply a plurality of thresholds dynamically determined on a per order basis to audio data that includes samples of spherical harmonic coefficients a plurality of spherical harmonic coefficients in order to generate a reduced set of the spherical harmonic coefficients.

In another aspect, a device comprises means for applying a plurality of thresholds dynamically determined on a per order basis to audio data that includes samples of spherical harmonic coefficients a plurality of spherical harmonic coefficients in order to generate a reduced set of the spherical harmonic coefficients.

In another aspect, a non-transitory computer-readable storage medium has stored thereon instructions that, when executed, cause one or more processors to dynamically determine a plurality of thresholds for the audio data that includes samples of spherical harmonic coefficients on a per order basis for the spherical harmonic coefficients, and apply the dynamically determined thresholds to the spherical harmonic coefficients so as to generate a reduced set of the spherical harmonic coefficients that does not include at least one of the spherical harmonic coefficients present in the samples of the spherical harmonic coefficients.

In another aspect, a method of compressing audio data comprised of spherical harmonic coefficients, the method comprises applying at least one threshold to the spherical harmonic coefficients so as to generate a reduced set of the spherical harmonic coefficients, wherein the at least one threshold is dynamically determined based on a diffusion analysis of the spherical harmonic coefficients.

In another aspect, a device comprises one or more processor configured to apply at least one threshold to spherical harmonic coefficients so as to generate a reduced set of the spherical harmonic coefficients, wherein the at least one threshold is dynamically determined based on a diffusion analysis of the spherical harmonic coefficients.

In another aspect, a device comprises means for applying at least one threshold to spherical harmonic coefficients so as to generate a reduced set of the spherical harmonic coefficients, wherein the at least one threshold is dynamically determined based on a diffusion analysis of the spherical harmonic coefficients.

In another aspect, a non-transitory computer-readable storage medium having stored thereon instructions that, when executed, cause one or more processors to apply at least one threshold to spherical harmonic coefficients so as to generate a reduced set of the spherical harmonic coefficients, wherein the at least one threshold is dynamically determined based on a diffusion analysis of the spherical harmonic coefficients.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
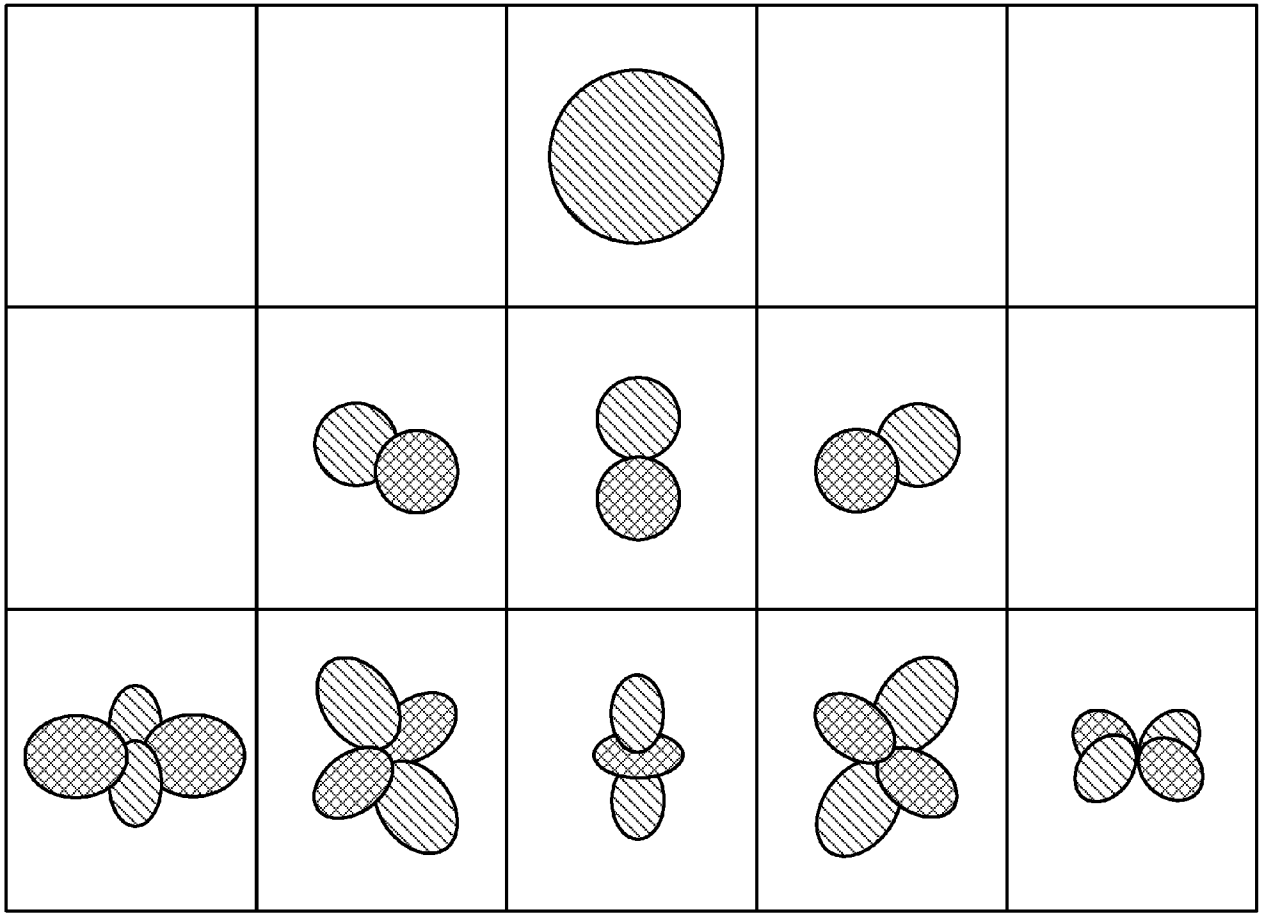
FIGS. 1-3 are diagrams illustrating spherical harmonic basis functions of various orders and sub-orders.

The evolution of surround sound has made available many output formats for entertainment nowadays. Examples of such surround sound formats include the popular 5.1 format (which includes the following six channels: front left (FL), front right (FR), center or front center, back left or surround left, back right or surround right, and low frequency effects (LFE)), the growing 7.1 format, and the upcoming 22.2 format (e.g., for use with the Ultra High Definition Television standard). Further examples include formats for a spherical harmonic array.

The input to the future MPEG encoder is optionally one of three possible formats: (i) traditional channel-based audio, which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the sound field using coefficients of spherical harmonic basis functions (also called "spherical harmonic coefficients" or SHC).

There are various 'surround-sound' formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend the efforts to remix it for each speaker configuration. Recently, standard committees have been considering ways in which to provide an encoding into a standardized bitstream and a subsequent decoding that is adaptable and agnostic to the speaker geometry and acoustic conditions at the location of the renderer.

To provide such flexibility for content creators, a hierarchical set of elements may be used to represent a sound field. The hierarchical set of elements may refer to a set of elements in which the elements are ordered such that a basic set of lower-ordered elements provides a full representation of the modeled sound field. As the set is extended to include higher-order elements, the representation becomes more detailed.

One example of a hierarchical set of elements is a set of spherical harmonic coefficients (SHC). The following expression demonstrates a description or representation of a sound field using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

This expression shows that the pressure $p_i$ at any point $\{r_r, \theta_r, \phi_r\}$ of the sound field can be represented uniquely by the SHC $A_n^m(k)$. Here, $$k = \frac{\omega}{c},$$

c is the speed of sound (~343 m/s), $\{r_r, \theta_r, \phi_r\}$ is a point of reference (or observation point), $j_n(\cdot)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega, r_r, \theta_r, \phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating a zero-order spherical harmonic basis function (first row), first-order spherical harmonic basis functions (second row) and second-order spherical harmonic basis functions (third row). The order (n) is identified by the rows of the table with the first row referring to the zero order, the second row referring to the first order and third row referring to the second order. The sub-order (m) is identified by the columns of the table, which are shown in more detail in FIG. 3. The SHC corresponding to zero-order spherical harmonic basis function may be considered as specifying the energy of the sound field, while the SHCs corresponding to the remaining higher-order spherical harmonic basis functions may specify the direction of that energy.

Figure 2:
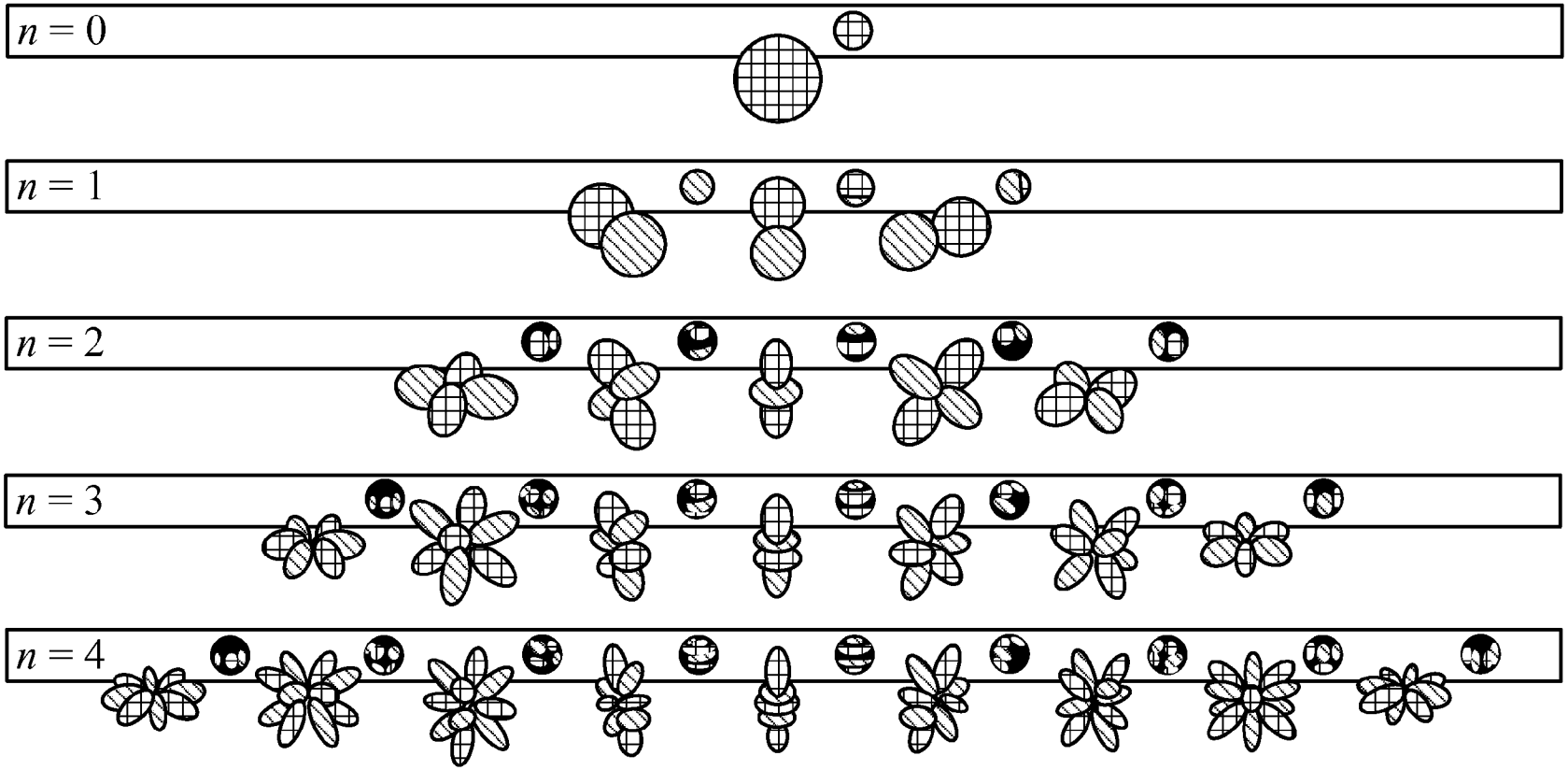

FIG. 2 is a diagram illustrating spherical harmonic basis functions from the zero order (n=0) to the fourth order (n=4). As can be seen, for each order, there is an expansion of suborders m which are shown but not explicitly noted in the example of FIG. 2 for ease of illustration purposes.

Figure 3:
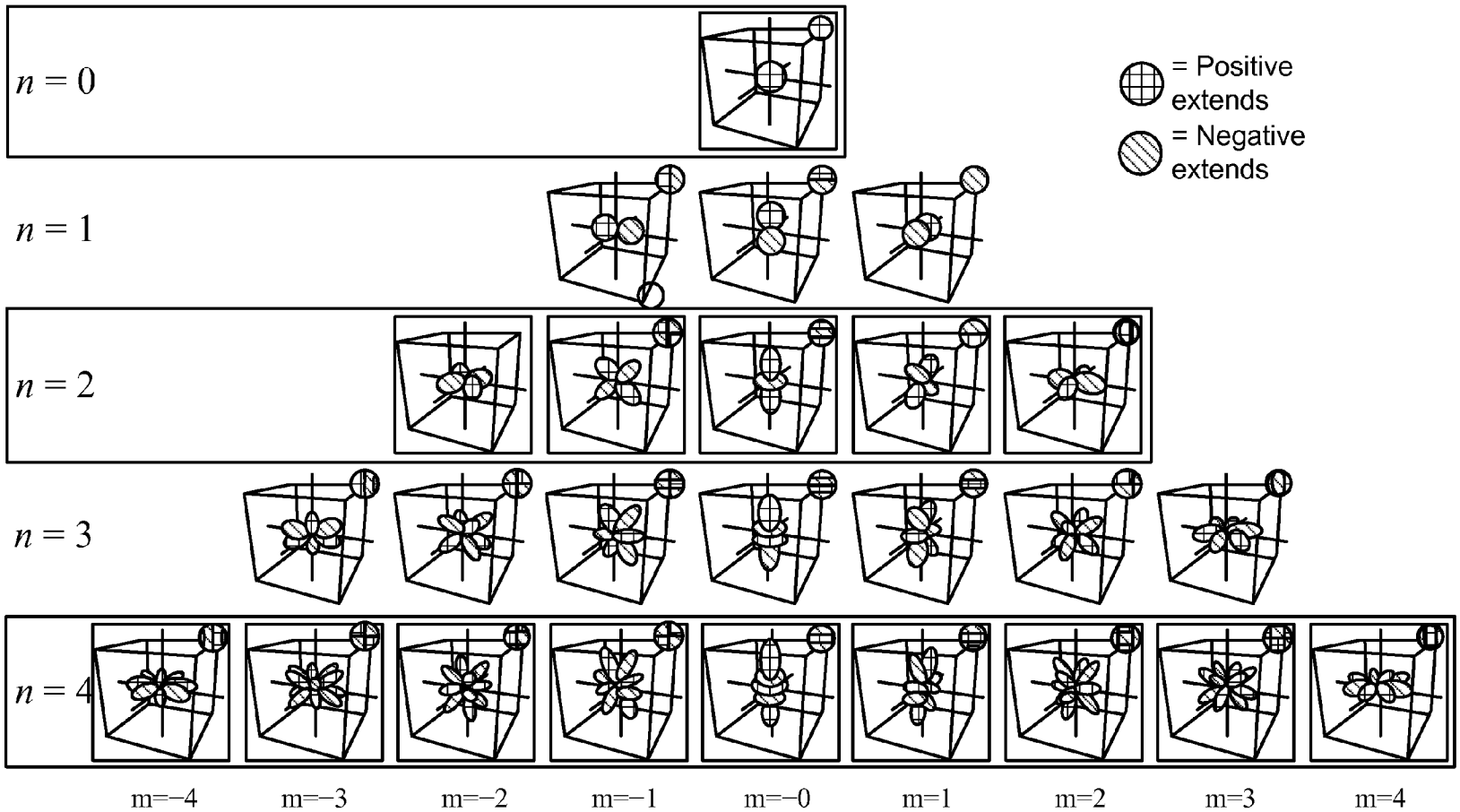

FIG. 3 is another diagram illustrating spherical harmonic basis functions from the zero order (n=0) to the fourth order (n=4). In FIG. 3, the spherical harmonic basis functions are shown in three-dimensional coordinate space with both the order and the suborder shown.

In any event, the SHC $A_n^m(k)$ can either be physically acquired (e.g., recorded) by various microphone array configurations or, alternatively, they can be derived from channel-based or object-based descriptions of the sound field. The former represents scene-based audio input to an encoder. For example, a fourth-order representation involving $1+2^4$ (25, and hence fourth order) coefficients may be used.

To illustrate how these SHCs may be derived from an object-based description, consider the following equation. The coefficients $A_n^m(k)$ for the sound field corresponding to an individual audio object may be expressed as $$A_n^m(k)=g(\omega)(-4\pi ik)h_n^{(2)}(kr_s)Y_n^{m*}(\theta_s,\phi_s),$$

where i is $\sqrt{-2}$, $h_n^{(2)}(\cdot)$ is the spherical Hankel function (of the second kind) of order n, and $\{r_s, \theta_s, \phi_s\}$ is the location of the object. Knowing the source energy $g(\omega)$ as a function of frequency (e.g., using time-frequency analysis techniques, such as performing a fast Fourier transform on the PCM stream) allows us to convert each PCM object and its location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_r, \theta_r, \phi_r\}$. The remaining figures are described below in the context of object-based and SHC-based audio coding.

Figure 4A:
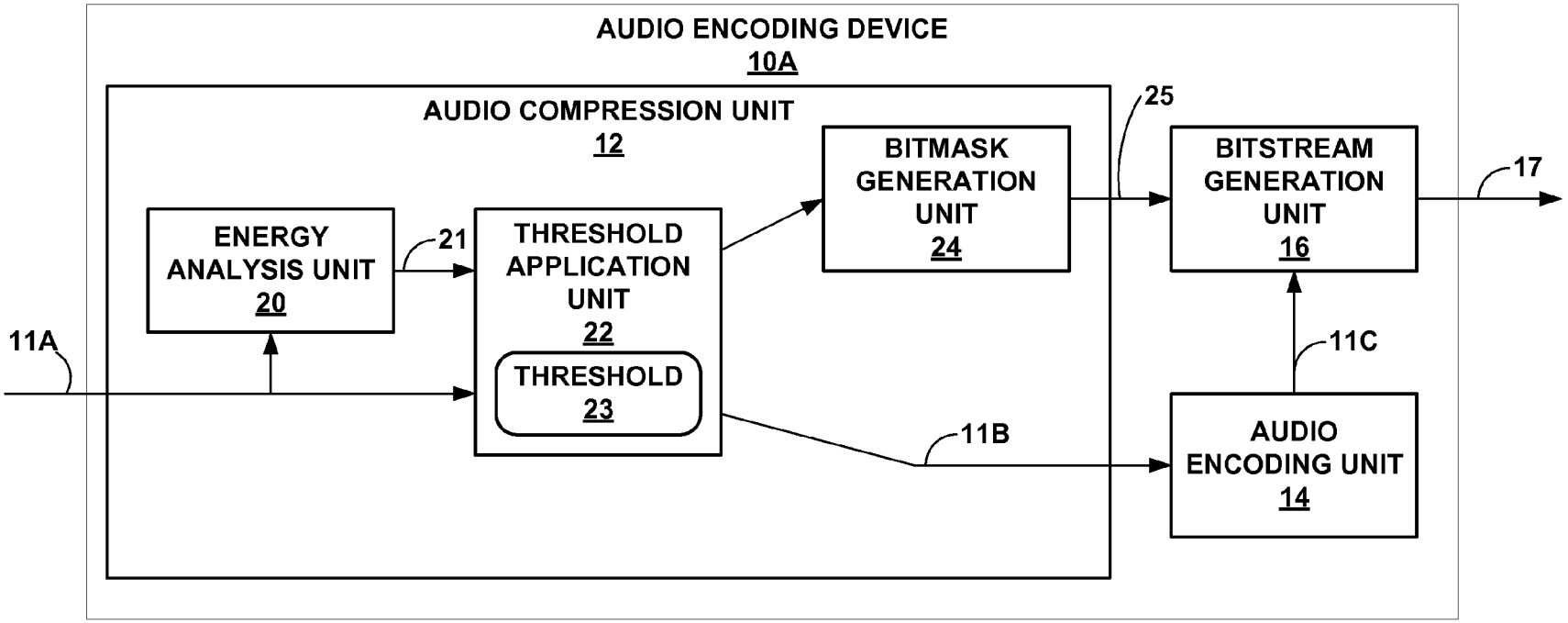
FIG. 4A-4C are block diagrams illustrating an example audio encoding device that may perform various aspects of the techniques described in this disclosure to code spherical harmonic coefficients describing two or three dimensional sound fields.
Figure 4B:
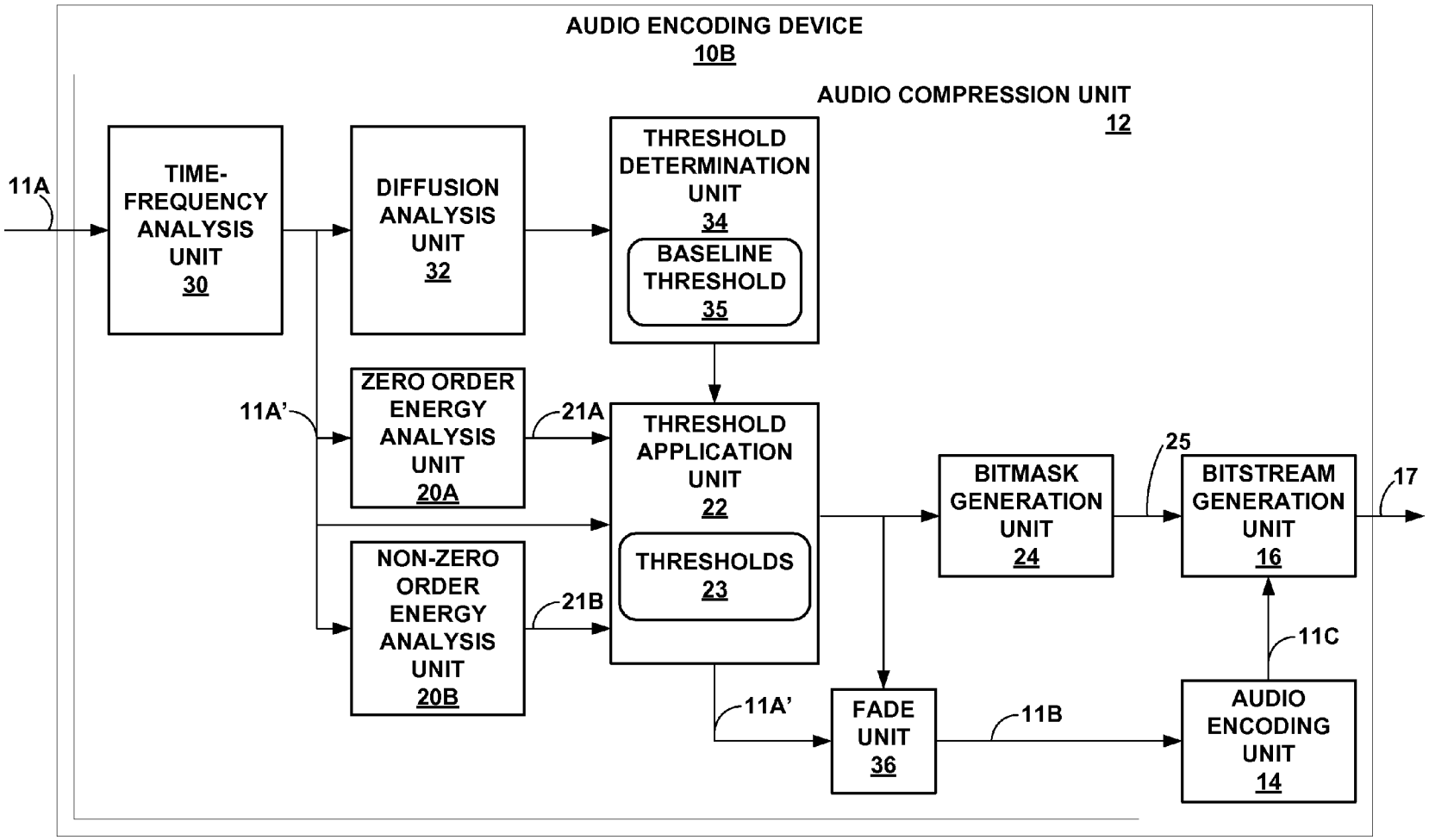
Figure 4C:
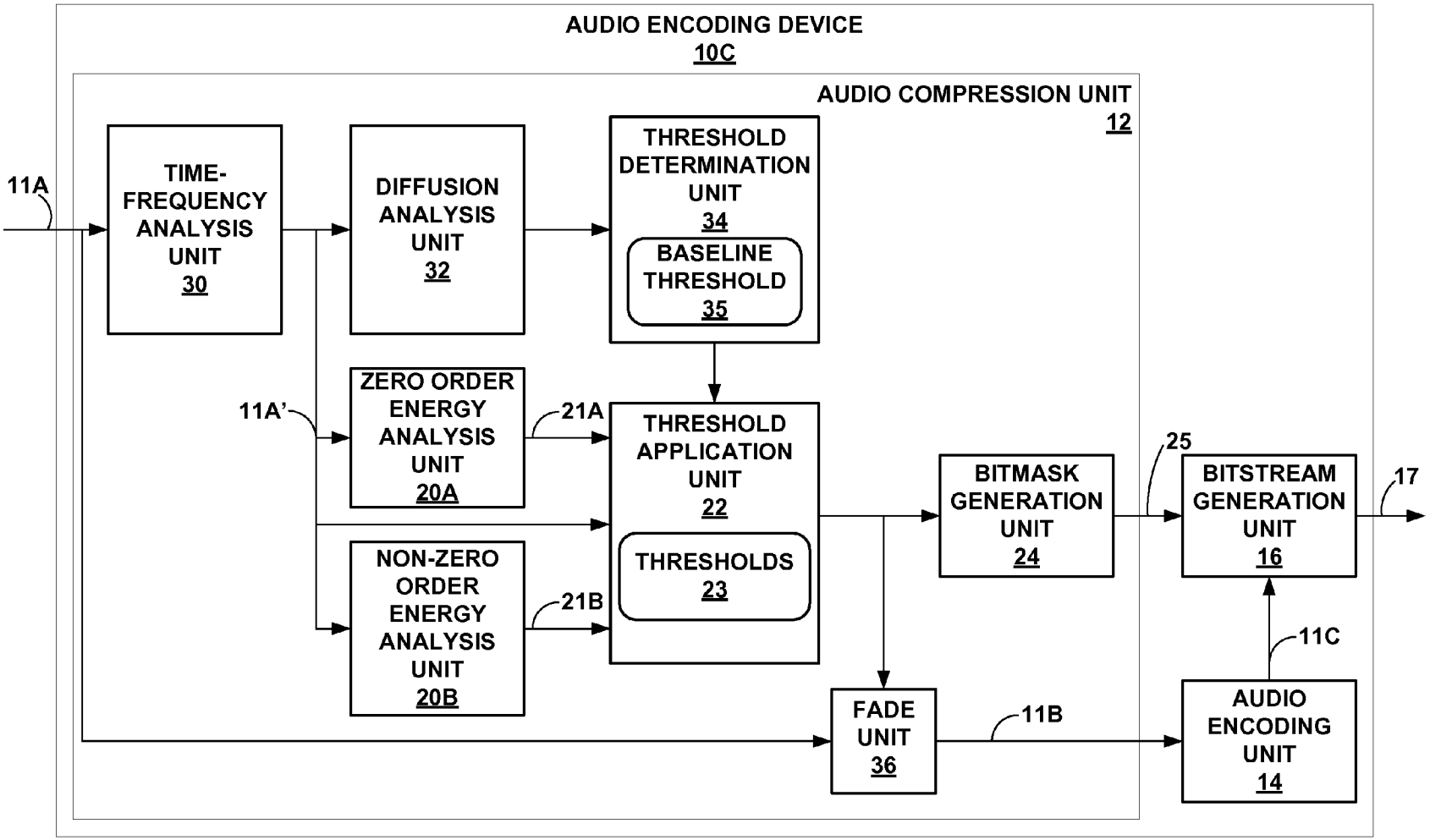

FIGS. 4A-4C are each a block diagram illustrating example audio encoding devices 10A-10C that may perform various aspects of the techniques described in this disclosure to code spherical harmonic coefficients describing two or three dimensional sound fields. In each of the examples of FIGS. 4A-4C, the audio encoding devices 10A-10C each generally represents any device capable of encoding audio data, such as a desktop computer, a laptop computer, a workstation, a tablet or slate computer, a dedicated audio recording device, a cellular phone (including so-called "smart phones"), a personal media player device, a personal gaming device, or any other type of device capable of encoding audio data.

While shown as a single device, i.e., the devices 10A-10C in the examples of FIGS. 4A-4C, the various components or units referenced below as being included within the devices 10A-10C may actually form separate devices that are external from the devices 10A-10C. In other words, while described in this disclosure as being performed by a single device, i.e., the devices 10A-10C in the examples of FIGS. 4A-4C, the techniques may be implemented or otherwise performed by a system comprising multiple devices, where each of these devices may each include one or more of the various components or units described in more detail below. Accordingly, the techniques should not be limited to the examples of FIG. 4A-4C.

As shown in the example of FIG. 4A, the audio encoding device 10A comprises an audio compression unit 12, an audio encoding unit 14 and a bitstream generation unit 16. The audio compression unit 12 may represent a unit that compresses spherical harmonic coefficients (SHC) 11A ("SHC 11A"). In some instances, the audio compression unit 12 represents a unit that losslessly compresses the SHC 11A. The SHC 11A may represent a plurality of SHCs, where at least one of the plurality of SHC have an order greater than one (where SHC of this variety are referred to as higher order ambisonics (HOA) so as to distinguish from lower order ambisonics of which one example is the so-called "B-format").

That is, the SHC 11A may refer to a coefficients associated with one or more spherical harmonics. These spherical harmonics may be analogous to the trigonometric basis functions of a Fourier series. That is, spherical harmonics may represent the fundamental modes of vibration of a sphere around a microphone similar to how the trigonometric functions of the Fourier series may represent the fundamental modes of vibration of a string. These coefficients may be derived by solving a wave equation in spherical coordinates that involves the use of these spherical harmonics. In this sense, the SHC 11A may represent a 3D sound field surrounding a microphone as a series of spherical harmonics with the coefficients denoting the volume multiplier of the corresponding spherical harmonic.

Lower-order ambisonics (which may also be referred to as first-order ambisonics) may encode sound information into four channels denoted W, X, Y and Z. This encoding format is often referred to as a "B-format." The W channel refers to a non-directional mono component of the captured sound signal corresponding to an output of an omnidirectional microphone. The X, Y and Z channels are the directional components in three dimensions. The X, Y and Z channels typically correspond to the outputs of three figure-of-eight microphones, one of which faces forward, another of which faces to the left and the third of which faces upward, respectively. These B-format signals are commonly based on a spherical harmonic decomposition of the soundfield and correspond to the pressure (W) and the three component pressure gradients (X, Y and Z) at a point in space. Together, these four B-format signals (i.e., W, X, Y and Z) approximate the sound field around the microphone. Formally, these B-format signals may express the first-order truncation of the multipole expansion.

Higher-order ambisonics refers to a form of representing a sound field that uses more channels, representing finer modal components, than the original first-order B-format. As a result, higher-order ambisonics may capture significantly more spatial information. The "higher order" in the term "higher order ambisonics" refers to further terms of the multimodal expansion of the function on the sphere in terms of spherical harmonics. Increasing the spatial information by way of higher-order ambisonics may result in a better expression of the captured sound as pressure over a sphere. Using higher order ambisonics to produce the SHC 20A may enable better reproduction of the captured sound by speakers present at the audio decoder.

In any event, while the audio compression unit 12 may losslessly compress the SHC 11A, typically the audio compression unit 12 removes those of the SHC 11A that are not salient or relevant in describing the sound field when reproduced (in that some may not be capable of being heard by the human auditory system). In this sense, the lossy nature of this compression may not overly impact the perceived quality of the sound field when reproduced from the compressed version of the SHC 11A.

As shown in the example of FIG. 4A, the audio compression unit 12 includes an energy analysis unit 20, a threshold application unit 22 and a bitmask generation unit 24. The energy analysis unit 20 represents a unit that receives the SHC 11A and performs an energy analysis with respect to the SHC 11A in order to identify orders and/or sub-orders of the SHC 11A having salient audio information (which may refer to information salient to describing the sound field when reproduced for consumption by the human auditory system). The energy analysis unit 20 may operate on the SHC 11A on an audio frame-by-audio frame basis. To illustrate, the energy analysis unit 20 may determine an energy for each frame of the SHC 11A, where a frame may, for example, refer to 1024 samples of the audio signal, each sample comprising 25 of the SHC 11A (when the order, n, is set to 4, for example), for a total of 25×1024 or 25,600 SHC per frame. The energy analysis unit 20 may output an energy volume 21 for each combination of order and sub-order to threshold application unit 22.

In some instances, although not shown in the example of FIG. 4A, the energy analysis unit 20 may include a smoothing unit that may apply a smoothing function to the energy volume 21 determined by the energy analysis unit 20. The smoothing function may smooth the energy volume 21 to avoid discontinuities in abruptly removing and introducing the SHC 11B into the bitstream 17. The smoothing unit may analyze energy volumes 21 generated based on the analysis of previous and subsequent frames of the SHC 11A by the energy analysis unit 20. In other words, prior to the threshold application unit 22 applying the threshold 23 for the current frame of the SHC 11A, the energy analysis unit 20 may determine an energy volume 21 for a subsequent frame of the SHC11A. The smoothing unit may then smooth the energy volume 21 determined for the current frame based on the energy volume for one or more of a previous frame and a subsequent frame of the SHC 11A.

The threshold application unit 22 may represent a unit that applies a threshold 23 to those of the SHC 11A having an order greater than zero (which may be referred to as the "non-zero order SHC 11A"). The threshold application unit 22 may not apply the threshold 23 to the zero-order one of the SHC 11A (which may be referred to as the "zero-order SHC 11A") given that this one of the SHC 11A corresponds to the basis function that defines the overall energy of the sound field (which, in other words, represents in some ways what may be considered as the gain of the sound field). In any event, while shown as applying a single threshold, i.e., the threshold 23 in the example of FIG. 4A, the threshold application unit 22 may apply multiple thresholds, where each threshold may correspond to a different order, sub-order or combinations of order and sub-order.

Moreover, the threshold application unit 22 may apply different thresholds based on a target bitrate to be achieved for a resulting bitstream 17. That is, in some examples, the threshold application unit 22 may apply one or more thresholds when the target bitrate is high (above 256 kilobits per second (Kbps), as one example) and a different set of one or more thresholds when the target bitrate is low (e.g., equal to or below 256 Kbps). While not shown in the example of FIG. 4A, the threshold application unit 22 may determine a target bitrate (which may be configured by a user via a user interface or set per application, etc.) and compare this target bitrate to a threshold bitrate (where 256 Kbps may represent the threshold bitrate in the example above) in order to determine when to apply various different non-zero sets of the thresholds 23. In some examples, the threshold application unit 22 may include multiple different threshold bitrates to distinguish between two, three, four or more different non-zero sets of thresholds 23.

In any event, the threshold application unit 22 may apply the threshold 23 to the energy volume 21 output by the energy analysis unit 20 in order to determine whether to include various order/sub-order combinations of the SHC 11A in the resulting bitstream 17. In some examples, the threshold application unit 22 multiplies the threshold 23 to the energy volumes 21 corresponding to the non-zero order SHC 11A and compares the result of this multiplication to the energy volume 21 corresponding to the zero-order SHC 11A.

If the result of this multiplication is greater than the energy volume 21 corresponding to the zero-order SHC 11A, the threshold application unit 22 outputs a one (or, in other words, a bit having a value of one) to the bitmask generation unit 24, and passes the corresponding order/sub-order of the non-zero order SHC 11A to audio encoding unit 14. If the result of this multiplication is not greater than the energy volume 21 corresponding to the zero-order SHC 11A, the threshold application unit 22 outputs a zero (or, in other words, a bit having a value of zero) to the bitmask generation unit 24 and does not pass the corresponding order/sub-order of the non-zero order SHC 11A to audio encoding unit 14 (effectively determining that these SHC 11A are not salient in describing the sound field and filtering these SHC 11A from the resulting bitstream 17). The threshold application unit 22 may, in this manner, pass SHC 11B to audio encoding unit 14, where the SHC 11B may be the same as SHC 11A when none of the order/sub-order combinations of the SHC 11A are filtered from the resulting bitstream 17.

The bitmask generation unit 24 represents a unit that generates a bitmask that identifies whether one or more of the SHC 11A are present in the bitstream for a given time duration (which, is often set to the duration of an audio frame). The bitmask generation unit 24 may receive the one bit values and form a bitmask 25, which is passed to the bitstream generation unit 16.

The audio encoding unit 14 may represent a unit that performs a form of encoding to further compress the SHC 11B. In some instances, this audio encoding unit 14 may represent one or more instances of an advanced audio coding (AAC) encoding unit. Often, the audio encoding unit 14 may invoke an instance of an AAC encoding unit for each of the order/sub-order combinations remaining in the SHC 11B. That is, for the zero-order SHC 11B, the audio encoding unit 14 may invoke a first instance of an AAC encoding unit, passing only the zero-order SHC 11B to this instance of the AAC encoding unit. If the first order, zero sub-order ones of the non-zero order SHC 11B are present in the SHC 11B, the audio encoding unit 14 may invoke a second, different instance of the AAC encoding unit to encode only these ones of the SHC 11B. More information regarding how the SHC 11B may be encoded using an AAC encoding unit can be found in a convention paper by Eric Hellerud, et al., entitled "Encoding Higher Order Ambisonics with AAC," presented at the 124$^{th}$ Convention, 2008 May 17-20 and available at: http://ro.uow.edu.au/cgi/viewcontent.cgi?article=8025&context=engpapers. The audio encoding unit 14 may output encoded SHC 11C to the bitstream generation unit 16.

The bitstream generation unit 16 represents a unit that formats data to conform to a known format (which may refer to a format known by a decoding device), thereby generating the bitstream 17. The bitstream generation unit 16 may include a multiplexer that multiplexes the bitmasks 25 with the encoded SHC 11C to form the bitstream 17.

In this way, the audio compression unit 12 of the audio encoding device 10A may perform the techniques described in this disclosure to compress the SHC 11A. That is, the audio compression unit 12 may invoke the energy analysis unit 20 to perform an energy analysis with respect to the SHC 11A to determine at least one energy volume 21. The audio compression unit 12 may next invoke the threshold application unit 22 to apply a threshold 23 to the at least one energy volume 21 to generate a reduced version of the plurality of spherical harmonic coefficients, i.e., the SHC 11B in the example of FIG. 4A, having at least one of the SHC 11A eliminated from the SHC 11A. The audio encoding device 10A may further invoke the bitstream generation unit 16 to generate a bitstream 17 based on the SHC 11B.

In some instances, when performing the energy analysis, the energy analysis unit 20 may perform an energy analysis with respect to each combination of an order and a sub-order to which the SHC 11A correspond to generate the at least one energy volume 21 corresponding to each combination of the order and the sub-order. In this instance, when applying the threshold, the threshold application unit 22 may apply the threshold to the energy volumes 21 corresponding to each combination of the order and the sub-order to determine whether to eliminate the corresponding combination of the order and the sub-order of the SHC 11A, and eliminating those of the SHC 11A corresponding to the combination of the order and the sub-order based on the determinations to generate the SHC 11B.

In some instances, when applying the threshold, the threshold application unit 22 may multiply the at least one energy volume 21 associated with those of the SHC 11A having an order greater than one by the threshold 23 to determine at least one comparison energy volume. The threshold application unit 22 may then determine whether the at least one comparison energy volume is greater than the at least one energy volume 21 associated with the one of the SHC 11A having an order equal to zero, and eliminate one or more of the SHC 11A having an order greater than one based on the determination.

In some instances, the energy analysis unit 20 may apply a smoothing function to the at least one energy volume 21 to generate at least one smoothed energy volume. When applying the threshold, the threshold application unit 22 may apply the threshold 23 to the at least one smoothed energy volume to generate the SHC 11B.

In some instances, the audio encoding device 10A may invoke the bitmask generating unit 24 to generate a bitmask 25 to identify the ones of the SHC 11A included and eliminated from the SHC 11B. In this instance, when generating the bitstream 17, the bitstream generation unit 16 generates the bitstream 17 to include the bitmask 25.

In some instances, the audio encoding device 10A may invoke the audio encoding unit 14 to audio encode the SHC 11B in accordance with an audio encoding scheme to generate encoded audio data 11C, where the bitstream generation unit 17 may, when generating the bitstream 17, generate the bitstream 17 to include the encoded audio data 11C. In some examples, the audio encoding scheme comprises an advanced audio encoding (AAC) scheme. In some examples, the audio encoding scheme comprises a parametric inter-channel audio encoding scheme, such as the motion picture expert's group (MPEG) Surround.

FIG. 4B is a block diagram illustrating another example of an audio encoding device 10B that may perform various aspects of the techniques to compress audio data. The audio encoding device 10B may be similar to audio encoding device 10A in that audio encoding device 10B includes energy analysis units 20A and 20B ("energy analysis units 20"), a threshold application unit 22, a bitmask generation unit 24, an audio encoding unit 14 and a bitstream generation unit 16. Audio encoding device 10B, however, further includes a time-frequency analysis unit 30, a diffusion analysis unit 32, a threshold determination unit 34 and a fade unit 36.

The time-frequency analysis unit 30 may represent a unit configured to perform a time-frequency analysis of SHC 11A in order to transform the SHC 11A from the time domain to the frequency domain. The time-frequency analysis unit 30 may output the SHC 11A', which may denote the SHC 11A as expressed in the frequency domain. Although described with respect to the time-frequency analysis unit 30, the techniques may be performed with respect to the SHC 11A left in the time domain rather than performed with respect to the SHC 11A' as transformed to the frequency domain, as shown in the example of FIG. 4C.

The diffusion analysis unit 32 may represent a unit configured to perform a form of diffusion analysis to identify a percentage of the sound field represented by the SHC 11A' that includes diffuse sounds (which may refer to sounds having low levels of direction or higher order SHC, meaning SHC having an order greater than zero or one). As one example, the diffusion analysis unit 32 may perform diffusion analysis in a manner similar to that described in a paper by Ville Pulkki, entitled "Spatial Sound Reproduction with Directional Audio Coding," published in the J. Audio Eng. Soc., Vol. 55, No. 6, dated June 2007. In some instances, the diffusion analysis unit 32 may only analyze a non-zero subset of the SHC 11A', such as the zero and first order ones of the SHC 11A', when performing the diffusion analysis to determine the diffusion percentage 33. The diffusion analysis unit 32 may output diffusion percentage 33 to the threshold determination unit 34.

The threshold determination unit 34 may represent a unit configured to determine the thresholds 23 for use by the threshold application unit 22. In some instances, the threshold determination unit 34 may dynamically determine the thresholds 23 based on the diffusion percentage. In some instances, the threshold determination unit 34 may dynamically determine the thresholds 23 per frequency bin (when the SHC 11A are transformed from the time domain to the frequency domain, such as in the example of FIG. 4B) to generate the thresholds 23 that apply to one or more of the frequency bins. In some examples, the threshold determination unit 34 may dynamically determine the thresholds 23 based on the order of the SHC 11A' to generate one or more order-specific thresholds 23. In some examples, the threshold determination unit 34 may determine the thresholds 23 based on the sub-order of the SHC 11A' to generate one or more sub-order-specific thresholds 23. In some examples, the threshold determination unit 34 may dynamically determine the thresholds 23 based on the order and the sub-order of the SHC 11A' to generate order, sub-order-specific thresholds 23. In some examples, the threshold determination unit 34 may dynamically determine the thresholds 23 based on a target bitrate to which the bitstream 17 is to correspond. While described as being separate ways by which to determine the thresholds for ease of illustration purposes, the threshold determination unit 34 may determine the thresholds 23 based on any combination of the foregoing examples.

In each of the above examples, the threshold determination unit 34 may base the dynamic generation of the thresholds on a baseline threshold 35. The baseline threshold 35 may represent a threshold 35 that is configurable by a user. In some examples, more than one baseline threshold 35 may be defined, where each of the baseline thresholds 35 may correspond to a different target bitrate to which the bitstream 17 is to correspond. In this way, the threshold determination unit 34 may determine target bitrate specific thresholds, where one or more higher threshold may be generated for lower target bitrates and one or more lower (relatively) thresholds may be generated for higher target bitrates. The threshold determination unit 34 may output the thresholds 23 to threshold application unit 22.

The zero-order energy analysis unit 20A may represent a unit configured to perform energy analysis with respect to those of the SHC 11A' having an order equal to zero. The zero-order energy analysis unit 20A may perform the energy analysis with respect to these ones of the SHC 11A' in a manner similar to that described above with respect to the energy analysis unit 20 of the audio encoding device 10A shown in the example of FIG. 4A to generate a zero-order energy volume 21A. The non-zero-order energy analysis unit 20B may represent a unit configured to perform energy analysis with respect to those of the SHC 11A' having an order greater than zero. The non-zero-order energy analysis unit 20B may perform the energy analysis with respect to these ones of the SHC 11A' in a manner similar to that described above with respect to the energy analysis unit 20 of the audio encoding device 10A shown in the example of FIG. 4A to generate a non-zero-order energy volume 21B. As noted above with respect to the energy analysis unit 20 of the audio encoding device 10A shown in the example of FIG. 4A, one or both of the energy analysis units 20 of the audio encoding device 10B may include a smoothing unit to smooth the energy volumes 21A and 21B ("energy volumes 21") for the reasons noted above.

Given that thresholds, as described in more detail below, may be applied on a per order, sub-order, both order and sub-order, frequency bin or other basis or combination of bases, the energy analysis units 20 may likewise generate energy volumes 21 on one or more of these basis or combination of bases. Accordingly, while described above as generating energy volumes, the energy analysis units 20 may generate multiple energy volumes on a per basis or combination of bases noted above, as well as, any other similar basis not explicitly set forth above.

The threshold application unit 22 may be similar to the threshold application unit 22 described above with respect to the example of FIG. 4A, except that the threshold application unit 22 of the example of FIG. 4B may apply the dynamically determined thresholds 23. The threshold application unit 22 may apply, in some instances, each of the thresholds 23 with respect to a different non-zero subset of the SHC 11A'. For example, when the thresholds 32 have been dynamically determined based on the order of the SHC 11A', the thresholds 23 may be order-specific such that, when applied, the threshold application unit 22 only applies each of the thresholds 23 to the ones of the SHC 11A' having the corresponding order. The threshold application unit 22 may apply the thresholds 23 determined in accordance with each of the examples listed above in a similar fashion. Rather than output SHC 11B in the manner similar to that described above with respect to the example of FIG. 4B, the threshold application unit 22 may output the SHC 11A' to fade unit 36. The threshold application unit 22 may also output a series of ones and zeros to bitmask generation unit 24 similar to that described above.

The fade unit 36 may represent a unit configured to fade in and fade out those of the SHC 11A' that are removed or re-introduced (after previously being removed or eliminated from SHC 11A') based on the ones and zeros output to bitmask generation unit 24. The fade unit 36 may slowly fade in those of the SHC 11A' reintroduced to the reduced set of the SHC 11B, and slowly fade out those of the SHC 11A' removed from the reduced set of the SHC 11B. The fade unit 36 may consider subsequent and/or previous frames of the SHC 11A' similar to the smoothing function described above to avoid abrupt transitions.

The audio encoding unit 14 may operate similarly to the audio encoding unit 14 described above with respect to the example of FIG. 4A to generate encoded audio data 11C. Likewise, the bitstream generation unit 16 may operate similarly to the bitstream generation unit 16 described above with respect to the example of FIG. 4A to generate the bitstream 17 based on the encoded audio data 11C.

In operation, the audio encoding device 10B may perform the techniques described in this disclosure to compress audio data (i.e., SHC 11A in the example of FIG. 4B). When performing the techniques, the audio encoding device 10B may invoke the energy analysis units 20 to perform an energy analysis with respect to SHC 11A' to determine the energy volumes 21. The audio encoding device 10B may also invoke the threshold determination unit 34 to dynamically determine at least one threshold 23 based on the SHC 11A'. The audio encoding device 10B may then invoke the threshold application unit 22 to apply the dynamically determined at least one threshold 23 to the energy volumes 21 to generate a reduced version of the spherical harmonic coefficients, i.e., SHC 11B in the example of FIG. 4B. The audio encoding device 10B may invoke the bitstream generation unit 16 to generate the bitstream 17 based on the encoded version of the SHC 11B, which is referred to as encoded audio data 11C in the example of FIG. 4B.

In some examples, the threshold determination unit 34, when dynamically determines the threshold 23, dynamically determines the threshold 23 based on a diffusion analysis (such as that performed by the diffusion analysis unit 32) of the SHC 11A' having an order equal to zero and an order equal to one. In other examples, the threshold determination unit 34, when dynamically determines the threshold 23, dynamically determines the threshold 23 on a per order basis for the SHC 11A'. In other examples, the threshold determination unit 34, when dynamically determines the threshold 23, dynamically determines the threshold 23 on a per sub-order basis for the SHC 11A'. In other examples, the threshold determination unit 34, when dynamically determines the threshold 23, dynamically determines the threshold 23 on an order and a sub-order basis for the SHC 11A'.

In some examples, the audio encoding device 10B invokes a time-frequency analysis unit 30 to transform the SHC 11A from a time domain to a frequency domain so as to generate a transformed plurality of spherical harmonic coefficients, i.e., SHC 11A' in the example of FIG. 4B. The threshold determination unit 34 may, when dynamically determines the threshold 23, dynamically determines the threshold 23 on a per frequency bin basis for the SHC 11A'. In some examples, when applying the dynamically determined threshold 23, the threshold application unit 22 may apply the dynamically determined threshold 23 to the energy volumes 21B to generate a reduced version of the transformed plurality of spherical harmonic coefficients having at least one of the spherical harmonic coefficients eliminated from the transformed plurality of spherical harmonic coefficients, which is denoted as SHC 11B in the example of FIG. 4B.

In some instances, when performing the energy analysis, the energy analysis unit 20A may perform an energy analysis with respect to those of the SHC 11A' having an order equal to zero to determine a zero-order energy volume 21A, while the energy analysis unit 20B may perform an energy analysis with respect to those of the SHC 11A' having an order greater than zero to determine non-zero-order energy volumes 21B.

In some instances, when performing the energy analysis, the energy analysis unit 20B may perform an energy analysis with respect to each combination of an order and a sub-order to which the SHC 11A' correspond to generate an energy volume 21B corresponding to each combination of the order and the sub-order. When applying the dynamically determined threshold 23, the threshold application unit 22 may apply the threshold 23 to the energy volumes 21B corresponding to each combination of the order and the sub-order to determine whether to eliminate the corresponding combination of the order and the sub-order of the SHC 11A'. The fade unit 36 may then eliminate those of the SHC 11A' corresponding to the combination of the order and the sub-order based on the determinations to generate the SHC 11B.

In some instances, when applying the dynamically determined threshold 23, the threshold application unit 22 may multiply the energy volume 21B by the dynamically determined threshold 23 to determine at least one comparison energy volume. The threshold application unit 22 may then determine whether the at least one comparison energy volume is greater than the energy volume 21A associated with those of the SHC 11A' having an order equal to zero, outputting a zero to indicate that one or more of those of the SHC 11A' having an order greater than zero has been eliminated. The fade unit 36 may then fade out those of the SHC 11A' to effectively eliminate one or more of the SHC 11A' having an order greater.

In some examples, one or both of the energy analysis units 20 may apply a smoothing function to one or both of the energy volumes 21A and 21B to generate one or more smoothed energy volumes. When applying the dynamically determined threshold 23, the threshold application unit 22 may apply the dynamically determined threshold 23 to the one or more smoothed energy volumes to generate the ones and zeros, which are passed to the fade unit 36 so as to generate the SHC 11B.

In some instances, the audio encoding device 10B may invoke the bitmask generation unit 24 to generate a bitmask 25 to identify the ones the SHC 11A' included and eliminated from the SHC 11A to form the SHC 11B. In these instances, when generating the bitstream 17, the bitstream generation unit 16 may generate the bitstream 17 to include the bitmask 25.

In some instances, the audio encoding device 10B may invoke an audio encoding unit 14 to encode the SHC 11B in accordance with an audio encoding scheme to generate encoded audio data 11C. When generating the bitstream 17, the bitstream generation unit 16 may generate the bitstream 17 to include the encoded audio data 11C. In some examples, the audio encoding scheme comprise an advanced audio encoding (AAC) scheme.

In some instances, audio encoding device 10B may, as noted above, invoke the fade unit 36 to apply a fading function to the SHC 11A' when generating the SHC 11B.

In this respect, the techniques may enable the threshold determination unit 34 to, for a sliding window of time, dynamically determine thresholds 23 for the audio data that includes the SHC 11A. The techniques may further enable the threshold application unit 22 to apply the dynamically determined thresholds 23 to the SHC 11A' for the sliding window of time so as to generate, working in conjunction with the fade unit 36, the SHC 11B that does not include at least one of the spherical harmonic coefficients present in the SHC 11A'.

In some examples, the sliding window of time comprises an audio frame, where an audio frame may comprise 1024 samples of SHC 11A'. Thus, in some examples, the threshold application unit 22 may receive 1024 samples of the SHC 11A', where each sample for fourth order ambisonics includes 25 different coefficients for a total of 25,600 SHC. The threshold application unit 22 may apply the thresholds 23 to these SHC 11A' to determine whether at any point during the frame the SHC 11A' having an order greater than zero provide salient information. If, during the frame, none of the SHC 11A' of a given order and sub-order combination provide salient information, the threshold application unit 22 may output a zero for that order/sub-order combination, whereupon the fade unit 36 may fade out those of the SHC 11A' corresponding to that order/sub-order combination. In this way, the threshold determination unit 34 may dynamically determine the thresholds 23 on a frame-by-frame basis for the SHC 11A'.

In some examples, the sliding window of time represents a larger window of time for those of the spherical harmonic coefficients having a lower order and a relatively smaller window of time for those of the spherical harmonic coefficients having a higher order. In other words, the window size may vary based on the order of the SHC 11A' so that for those of the SHC 11A' having a lower order (such as an order less than or equal to one) the window is set to a full frame (or, as one example, 1024 samples of SHC 11A'). For those of the SHC 11A' having an order greater than one (as one example), the window may be set to 128 samples or possibly larger if the windows are overlapping. Having shorter windows allows for more adaptive thresholding that changes more quickly while longer windows allows for less adaptive thresholding that changes less quickly (relatively). As a result of using eight windows (1024/128 equals eight) per frame, threshold application unit 22 may output ones and zeros to the bitmask generation unit 24 eight times per frame, where the bitmask of ones and zeros may be specified using 24 bits (given that the zero order ones of SHC 11A' are always included in the bitstream 17) times eight for a total bitmask of 192 bits.

Moreover, various aspects of the techniques may also enable the audio encoding device 10B to dynamically determine the thresholds 23 for the SHC 11A' on a per order basis (where the order refers to the order n associated with the SHC 11A'). That is, the threshold determination unit 34 may determine the thresholds 23 for the SHC 11A' on a per order basis. The threshold determination unit 22 may then apply the dynamically determined thresholds 23 to the SHC 11A' so as to generate, working in conjunction with the fade unit 36, the SHC 11B.

In some examples, the threshold determination unit 34 may, when dynamically determining the thresholds 23, dynamically determine 24 thresholds for each combination of order and sub-order of the spherical harmonic coefficients except for those of the spherical harmonic coefficients having an order and sub-order of zero, wherein a maximum order of the spherical harmonic coefficients is four.

In some instances, when dynamically determining the thresholds 23, the threshold determination unit 34 may, for a sliding window of time, dynamically determine the plurality of thresholds on a per order basis for the SHC 11A', as described above. In these instances, the sliding window of time represents a larger window of time for those of the spherical harmonic coefficients having a lower order and a relatively smaller window of time for those of the spherical harmonic coefficients having a higher order.

Moreover, various aspects of the techniques may enable the audio encoding device 10B to invoke the threshold determination unit 34 to dynamically determine the threshold 23 based on a diffusion analysis of the SHC 11A'. In some instances, when dynamically determining the threshold 23, the threshold determination unit 34 may dynamically determining the threshold 23 based on a diffusion analysis of at least those of the SHC 11A' having an order equal to zero and an order equal to one. The threshold application unit 22 may then apply the dynamically determined threshold 23 to the SHC 11A' so as to generate, working in conjunction with the fade unit 36, the SHC 11B.

In some instances, when dynamically determining the threshold 23, the threshold determination unit 34 may dynamically determining a plurality of thresholds 23 based on the diffusion analysis and on a per order basis in a manner similar to that described above. In these instances, when dynamically determining the thresholds 23, the threshold determination unit 34 may dynamically determining 24 thresholds for each combination of order and sub-order of the SHC 11A' except for those of the SHC 11A' having an order and sub-order of zero, where a maximum order of the spherical harmonic coefficients is four.

In some instances, when dynamically determining the threshold 23, the threshold determination unit 34 may, for a sliding window of time, dynamically determining the thresholds 23 based on the diffusion analysis. In these instances, the sliding window of time represents a larger window of time for those of the spherical harmonic coefficients having an lower order and a relatively smaller window of time for those of the spherical harmonic coefficients having a higher order.

FIG. 4C is a block diagram illustrating another example of an audio encoding device 10C that may perform various aspects of the techniques to compress audio data. The audio encoding device 10C may be substantially similar to the audio encoding device 10B, except that the fade unit 36 removes non-transformed versions of the SHC, i.e., SHC 11A in the example of FIG. 4C. In this respect, the techniques may enable a bitstream 17 to be generated based on the SHC 11A expressed in the time domain rather than the SHC 11A', which are expressed in the frequency domain.

Thus, rather than encode all of the SHC 11A or SHC 11A', which would potentially require significant bandwidth for transmitting and storing the data, the techniques may reduce bandwidth requirements through thresholding. In other words, to reduce the number of SHC, the techniques may transmit and store only the salient SHC, while suppressing all other SHC based on a dynamic signal energy threshold (i.e., threshold 23 in the examples of FIGS. 4A-4C). The energy threshold may be estimated by the energy of the $0^{th}$ order SHC, relative to the higher order SHC. If a higher order SH coefficient contains less than a pre-defined ratio of the energy found in the 0th order at the same time, this higher order coefficient may be suppressed. In this way, bandwidth reduction is achieved.

In some instances, a pre-defined threshold may be provided to take into account the SH normalization scheme employed so that there is no bias based on order or sub-order of the spherical harmonic.

In some instances, to reduce the number of required SHC, and to avoid perceptual artifacts, the techniques may dynamically adjust this threshold and in a multi-resolution manner—based on a number of parameters and conditions. These parameters may comprise a) observation time window, b) frequency content, c) frequency-dependent observation time d) the Ambisonics order the SHC relates to, e) diffuse sound estimation, and/or coherence measure across Ambisonics coefficients.

In more detail a) above may involve performing the energy analysis over a sliding window which whose duration is adjustable (most likely up to about 300 ms, but not really limited). This window may prevent SHC from changing their detected state from 'active' to 'suppressed' too rapidly. When changing their state, the techniques may also employ a fade-in and fade-out on the SHC to potentially avoid a so-called 'zipper'-noise.

In more detail, b) above may involve performing the energy analysis as a function of the time frequency (pitch) to account for the frequency-dependent sensitivities of the human auditory system. The length of the sliding time window, described in a), may be made a function of the frequency, making the analysis 'multi-resolution'.

In more detail, c) above may involve making the length of the sliding window, described in a) above to be a function of the SH mode—such that higher modal SHC are analyzed over smaller time-windows making the analysis multi-resolution.

In more detail, d) above may involve weighting the energy threshold higher with increasing Ambisonic order, potentially ensuring greater suppression of higher-order SHC (as compared to lower order SHC).

In more detail, e) above may involve controlling the energy threshold by a computed 'diffusion' or 'coherence' measure across the SHC. In a diffused sound scene (such as in a reverberant recording), the diffused content may be described with just the lower order SHC. For sudden non-diffuse events, (such as a handclap), the diffusion measure may decrease, and the higher-order SHC are less likely to be suppressed.

Figure 5:
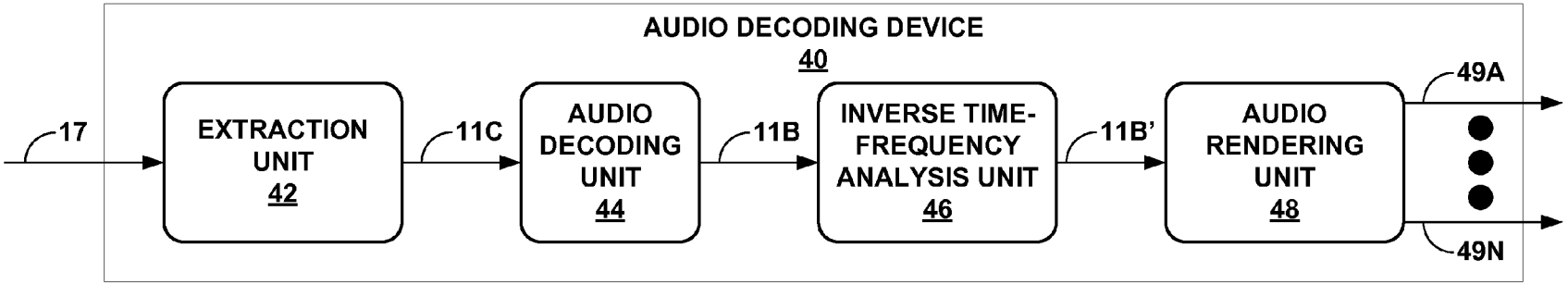
FIG. 5 is a block diagram illustrating an example audio decoding device that may perform various aspects of the techniques described in this disclosure to decode spherical harmonic coefficients describing two or three dimensional sound fields.

FIG. 5 is a block diagram illustrating an example audio decoding device 40 that may perform various aspects of the techniques described in this disclosure to decode spherical harmonic coefficients describing three dimensional sound fields. The audio decoding device 40 generally represents any device capable of decoding audio data, such as a desktop computer, a laptop computer, a workstation, a tablet or slate computer, a dedicated audio recording device, a cellular phone (including so-called "smart phones"), a personal media player device, a personal gaming device, or any other type of device capable of decoding audio data.

Generally, the audio decoding device 40 performs an audio decoding process that is reciprocal to the audio encoding process performed by any of the audio encoding devices 10A-10C with the exception of performing the thresholding, which is typically used by the audio encoding devices 10A-10C to facilitate the removal of extraneous irrelevant data (e.g., data that would be incapable of being perceived by the human auditory system). In other words, the audio encoding devices 10A-10C may remove some of the audio data as the typical human auditory system may be unable to discern the lack of precision in these areas. Given that this audio data is irrelevant, the audio decoding device 4—need not perform spatial analysis to reinsert such extraneous audio data.

While shown as a single device, i.e., the device 40 in the example of FIG. 5, the various components or units referenced below as being included within the device 40 may form separate devices that are external from the device 40. In other words, while described in this disclosure as being performed by a single device, i.e., the device 40 in the example of FIG. 5, the techniques may be implemented or otherwise performed by a system comprising multiple devices, where each of these devices may each include one or more of the various components or units described in more detail below. Accordingly, the techniques should not be limited to the example of FIG. 5.

As shown in the example of FIG. 5, the audio decoding device 40 comprises an extraction unit 42, an audio decoding unit 44, an inverse time-frequency analysis unit 46, and an audio rendering unit 48. The extraction unit 42 represents a unit configured to extract both the bitmask 25 and, based on the bitmask 25, the encoded audio data 11C. The extraction unit 42 outputs the encoded audio data 11C to audio decoding unit 44. The audio decoding unit 44 represents a unit to decode the encoded audio data (often in accordance with a reciprocal audio decoding scheme, such as an AAC decoding scheme) so as to recover SHC 11B. The audio decoding unit 44 outputs the SHC 11B (which is assumed to be in the frequency domain in this example) to the inverse time-frequency analysis unit 46.

The inverse time-frequency analysis unit 46 may represent a unit configured to perform an inverse time-frequency analysis of the SHC 11B in order to transform the SHC 11B from the frequency domain to the time domain. The inverse time-frequency analysis unit 46 may output the SHC 11B', which may denote the SHC 11B as expressed in the time domain. Although described with respect to the inverse time-frequency analysis unit 46, the techniques may be performed with respect to the SHC 11B in the frequency domain rather than performed with respect to the SHC 11B' in the time domain.

The audio rendering unit 48 represents a unit configured to render the channels 49A-49N (the "channels 49," which may also be generally referred to as the "multi-channel audio data 49" or as the "loudspeaker feeds 49"). The audio rendering unit 48 may apply a transform (often expressed in the form of a matrix) to the SHC 11B'. Because the SHC 11B' describe the sound field in three dimensions, the SHC 11B' represent an audio format that facilitates rendering of the multichannel audio data 49 in a manner that is capable of accommodating most decoder-local speaker geometries (which may refer to the geometry of the speakers that will playback multi-channel audio data 49). More information regarding the rendering of the multi-channel audio data 49 is described below with respect to FIG. 6.

Figure 6:
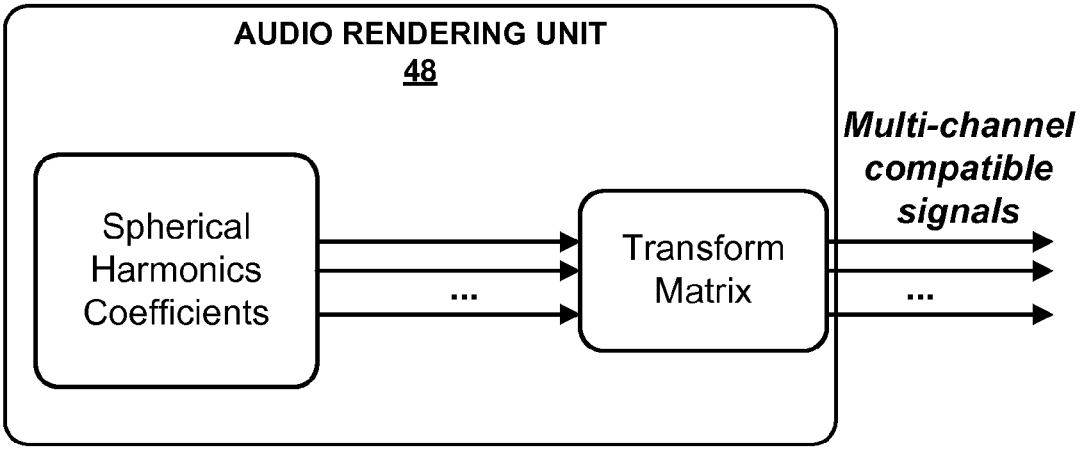
FIG. 6 is a block diagram illustrating the audio rendering unit shown in the example of FIG. 5 in more detail.
Figure 7:
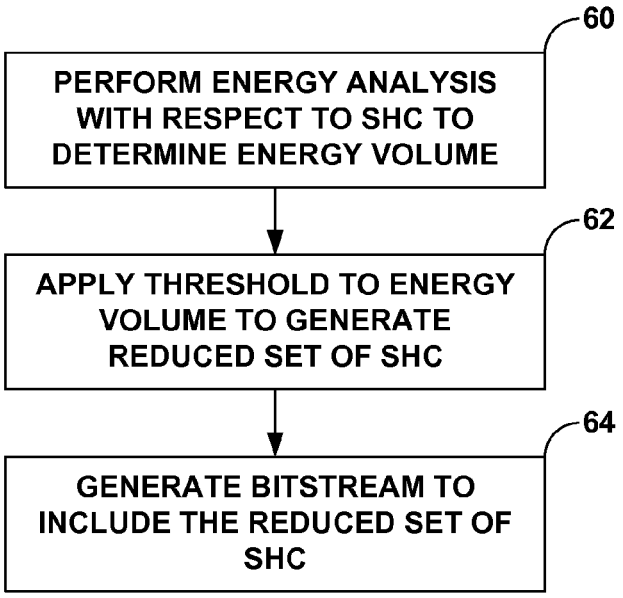
FIGS. 7-11 are flowcharts each of which illustrates exemplary operation of an audio encoding device in performing various aspects of the techniques described in this disclosure.
Figure 8:
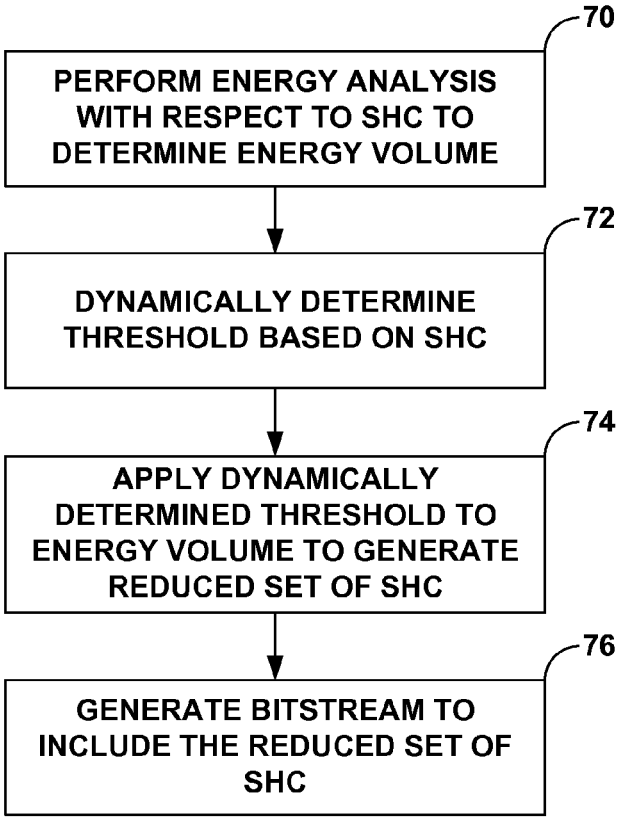

FIG. 6 is a block diagram illustrating the audio rendering unit 48 of the audio decoding device 40 shown in the example of FIG. 5 in more detail. Generally, FIG. 6 illustrates a conversion from the SHC 11B' to the multi-channel audio data 49 that is compatible with a decoder-local speaker geometry. For some local speaker geometries (which, again, may refer to a speaker geometry at the decoder), some transforms that ensure invertibility may result in less-than-desirable audio-image quality. That is, the sound reproduction may not always result in a correct localization of sounds when compared to the audio being captured. In order to correct for this less-than-desirable image quality, the techniques may be further augmented to introduce a concept that may be referred to as "virtual speakers."

Rather than require that one or more loudspeakers be repositioned or positioned in particular or defined regions of space having certain angular tolerances specified by a standard, such as the above noted ITU-R BS.775-1, the above framework may be modified to include some form of panning, such as vector base amplitude panning (VBAP), distance based amplitude panning, or other forms of panning Focusing on VBAP for purposes of illustration, VBAP may effectively introduce what may be characterized as "virtual speakers." VBAP may generally modify a feed to one or more loudspeakers so that these one or more loudspeakers effectively output sound that appears to originate from a virtual speaker at one or more of a location and angle different than at least one of the location and/or angle of the one or more loudspeakers that supports the virtual speaker.

To illustrate, the following equation for determining the loudspeaker feeds in terms of the SHC may be as follows:

$$\begin{bmatrix} A_0^0(\omega) \\ A_1^1(\omega) \\ A_1^{-1}(\omega) \\ \dots \\ A_{(Order+1)(Order+1)}^{-(Order+1)(Order+1)}(\omega) \end{bmatrix} = -ik \begin{bmatrix} VBAP \\ \text{MATRIX} \\ MxN \end{bmatrix} \begin{bmatrix} D \\ Nx(\text{Order}+1)^2 \end{bmatrix} \begin{bmatrix} g_1(\omega) \\ g_2(\omega) \\ g_3(\omega) \\ \dots \\ g_M(\omega) \end{bmatrix}.$$

In the above equation, the VBAP matrix is of size M rows by N columns, where M denotes the number of speakers (and would be equal to five in the equation above) and N denotes the number of virtual speakers. The VBAP matrix may be computed as a function of the vectors from the defined location of the listener to each of the positions of the speakers and the vectors from the defined location of the listener to each of the positions of the virtual speakers. The D matrix in the above equation may be of size N rows by $(\text{order}+1)^2$ columns, where the order may refer to the order of the SH functions. The D matrix may represent the following $$\text{matrix:}\begin{bmatrix} h_0^{(2)}(kr_1)Y_0^{0*}(\theta_1,\varphi_1) & h_0^{(2)}(kr_2)Y_0^{0*}(\theta_2,\varphi_2) & \dots & \dots & \dots \\ h_1^{(2)}(kr_1)Y_1^{1*}(\theta_1,\varphi_1). & \dots & \dots & \dots & \dots \\ \dots & \dots & \dots & \dots & \dots \\ \dots & \dots & \dots & \dots & \dots \\ \dots & \dots & \dots & \dots & \dots \end{bmatrix}.$$

The g matrix (or vector, given that there is only a single column) may represent the gain for speaker feeds for the speakers arranged in the decoder-local geometry. In the equation, the g matrix is of size M. The A matrix (or vector, given that there is only a single column) may denote the SHC 20A, and is of size (Order+1)(Order+1), which may also be denoted as $(\text{Order}+1)^2$.

In effect, the VBAP matrix is an M×N matrix providing what may be referred to as a "gain adjustment" that factors in the location of the speakers and the position of the virtual speakers. Introducing panning in this manner may result in better reproduction of the multi-channel audio that results in a better quality image when reproduced by the local speaker geometry. Moreover, by incorporating VBAP into this equation, the techniques may overcome poor speaker geometries that do not align with those specified in various standards.

In practice, the equation may be inverted and employed to transform the SHC 20A back to the multi-channel feeds 40 for a particular geometry or configuration of loudspeakers, which again may be referred to as the decoder-local geometry in this disclosure. That is, the equation may be inverted to solve for the g matrix. The inverted equation may be as follows:

$$\begin{bmatrix} g_1(\omega) \\ g_2(\omega) \\ g_3(\omega) \\ \dots \\ g_M(\omega) \end{bmatrix} = -ik\begin{bmatrix} VBAP \\ \text{MATRIX}^{-1} \\ MxN \end{bmatrix}\begin{bmatrix} D^{-1} \\ Nx(\text{Order}+1)^2 \end{bmatrix}\begin{bmatrix} A_0^0(\omega) \\ A_1^1(\omega) \\ A_1^{-1}(\omega) \\ \dots \\ A_{(Order+1)(Order+1)}^{-(Order+1)(Order+1)}(\omega) \end{bmatrix}.$$

The g matrix may represent speaker gain for, in this example, each of the five loudspeakers in a 5.1 speaker configuration. The virtual speakers locations used in this configuration may correspond to the locations defined in a 5.1 multichannel format specification or standard. The location of the loudspeakers that may support each of these virtual speakers may be determined using any number of known audio localization techniques, many of which involve playing a tone having a particular frequency to determine a location of each loudspeaker with respect to a headend unit (such as an audio/video receiver (A/V receiver), television, gaming system, digital video disc system, or other types of headend systems). Alternatively, a user of the headend unit may manually specify the location of each of the loudspeakers. In any event, given these known locations and possible angles, the headend unit may solve for the gains, assuming an ideal configuration of virtual loudspeakers by way of VBAP.

In this respect, the techniques may enable a device or apparatus to perform a vector base amplitude panning or other form of panning on the plurality of virtual channels to produce a plurality of channels that drive speakers in a decoder-local geometry to emit sounds that appear to originate form virtual speakers configured in a different local geometry. The techniques may therefore enable the audio decoding device 40 to perform a transform on the plurality of spherical harmonic coefficients, such as the SHC 11B', to produce a plurality of channels. Each of the plurality of channels may be associated with a corresponding different region of space. Moreover, each of the plurality of channels may comprise a plurality of virtual channels, where the plurality of virtual channels may be associated with the corresponding different region of space. The techniques may, in some instances, enable a device to perform vector base amplitude panning on the virtual channels to produce the plurality of channel of the multi-channel audio data 49.

Figure 9:
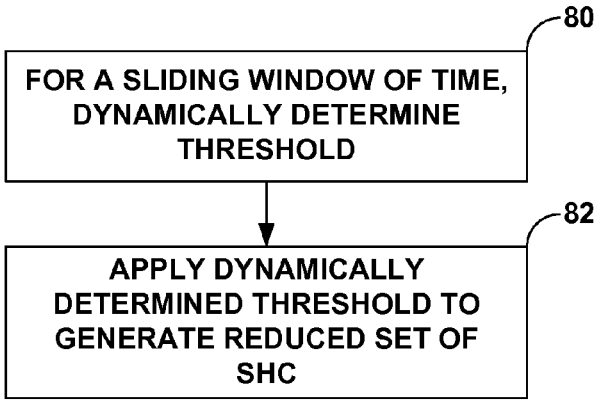

FIG. 9 is a flowchart illustrating exemplary operation of an audio encoding device, such as the audio encoding device 10A shown in the example of FIG. 4A, in performing various aspects of the techniques described in this disclosure. The audio encoding device 10A may perform an energy analysis with respect to the SHC 11A' to determine at least one energy volume 21 (60). The audio encoding device 10A may then apply a threshold 23 to the at least one energy volume 21 to generate the reduced set of SHC 11A', i.e., the SHC 11B shown in the example of FIG. 4A (62). The audio encoding device 10A may then generate the bitstream 17 based on the SHC 11B (64).

Figure 10:
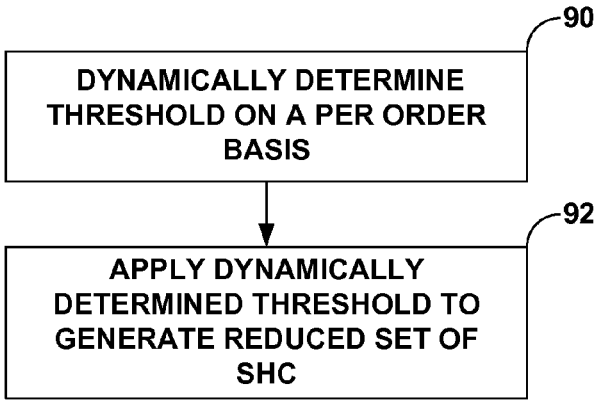

FIG. 10 is a flowchart illustrating exemplary operation of an audio encoding device, such as the audio encoding device 10B shown in the example of FIG. 4B, in performing various aspects of the techniques described in this disclosure. The audio encoding device 1BA may perform an energy analysis with respect to the SHC 11A' to determine at least one energy volume 21 (70). The audio encoding device 10B may also dynamically determine at least one threshold 23 based on the SHC 11A' (72). The audio encoding device 10B may then apply the dynamically determined threshold 23 to the at least one energy volume 21 to generate the reduced set of SHC 11A', i.e., the SHC 11B shown in the example of FIG. 4A (74). The audio encoding device 10A may then generate the bitstream 17 based on the SHC 11B (76).

Figure 11:
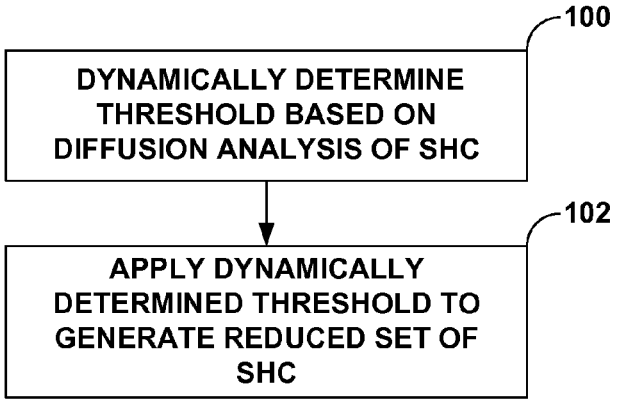

FIG. 11 is a flowchart illustrating exemplary operation of an audio encoding device, such as the audio encoding device 10B shown in the example of FIG. 4B, in performing various aspects of the techniques described in this disclosure. The audio encoding device 10B may, for a sliding window of time, dynamically determine thresholds 23 for the audio data that includes SHC 11A (80). The audio encoding device 10B may then apply the dynamically determined thresholds 23 to the SHC 11A' for the sliding window of time so as to generate the reduced set of the SHC 11A', which is denoted as the SHC 11B in the example of FIG. 4B (82).

Figure 12:
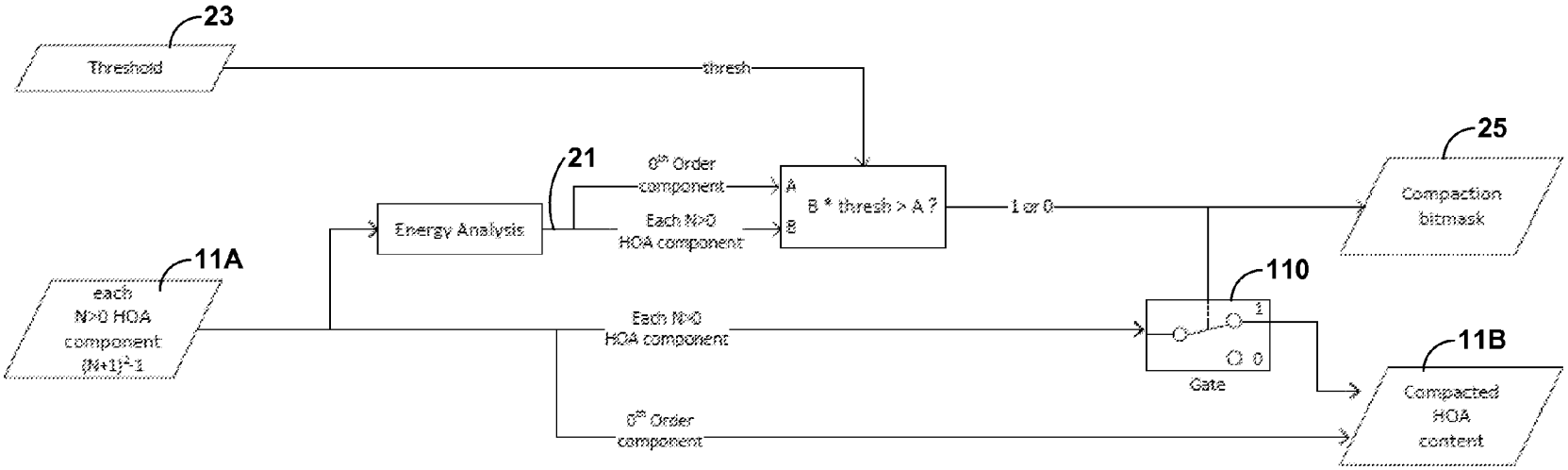
FIGS. 12 and 13 are diagrams each of which illustrate exemplary operation of an audio encoding device in performing various aspects of the techniques described in this disclosure.

FIG. 12 is a flowchart illustrating exemplary operation of an audio encoding device, such as the audio encoding device 10B shown in the example of FIG. 4B, in performing various aspects of the techniques described in this disclosure. The audio encoding device 10B may dynamically determine the thresholds 23 for the audio data that includes SHC 11A on a per order basis for the SHC 11A (90). The audio encoding device 10B may then apply the dynamically determined thresholds 23 to the SHC 11A' so as to generate a reduced set of the SHC 11A, which is denoted as the SHC 11B in the example of FIG. 4B (92).

Figure 13:
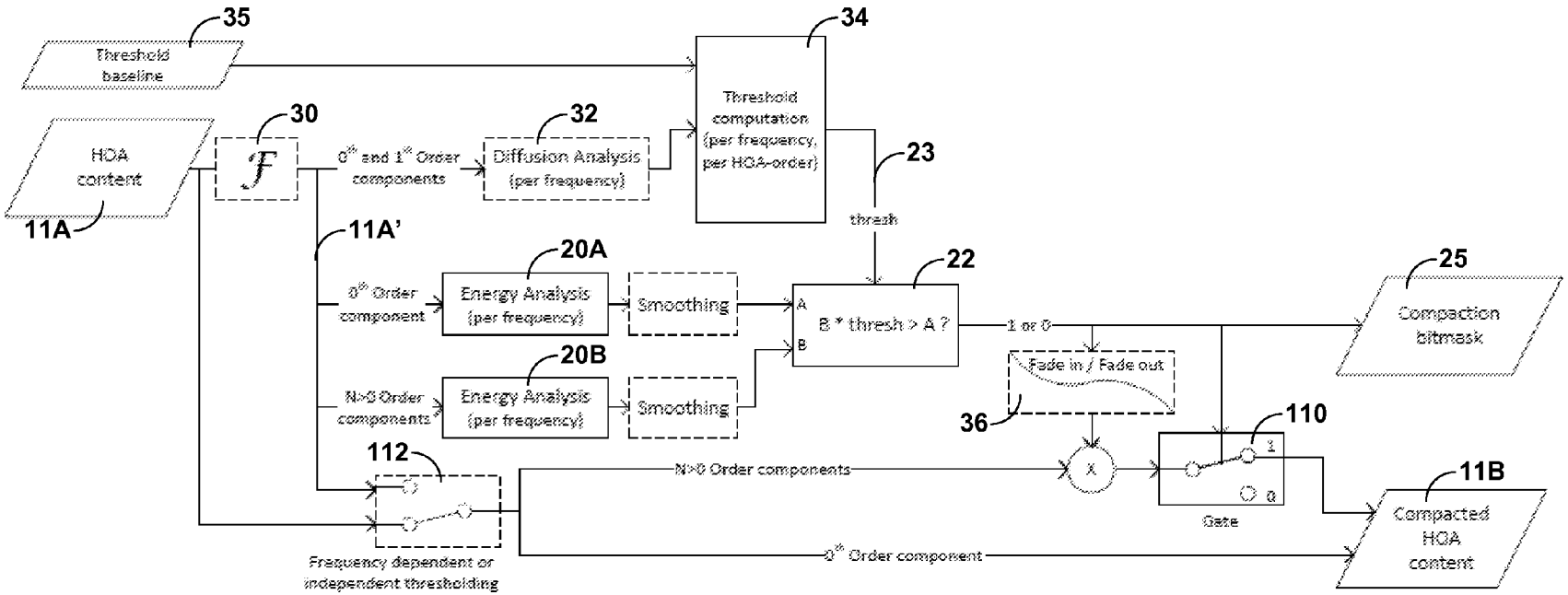

FIG. 13 is a flowchart illustrating exemplary operation of an audio encoding device, such as the audio encoding device 10B shown in the example of FIG. 4B, in performing various aspects of the techniques described in this disclosure. The audio encoding device 10B may dynamically determine the thresholds 23 based on a diffusion analysis of the SHC 11A' (100). The audio encoding device 10B may then apply the dynamically determined threshold 23 to the SHC 11A' so as to generate a reduced set of the SHC 11A, which is denoted as the SHC 11B in the example of FIG. 4B (102).

FIG. 14 is a diagram illustrating exemplary operation of an audio encoding device, such as the audio encoding device 10A shown in the example of FIG. 4A, in performing various aspects of the techniques described in this disclosure. FIG. 14 represents another way by which to diagram the operations performed by the audio compression unit 12 of the audio encoding device 10A. As shown in the example of FIG. 14, the audio encoding device 10A may receive a threshold 23. For each higher order ambisonic (SHC 11A) having an order (N) greater than zero (or, in other words, for those of SHC 11A having an order greater than zero), the audio encoding device 10A performs an energy analysis to determine the energy volumes 21. The audio encoding device 10A may also perform an energy analysis for the zero-order ones of SHC 11A, multiplying the threshold 23 by the non-zero ordered energy volumes 21 and comparing the result of this modification to the zero-ordered energy volumes 21.

When the result of this multiplication is greater than the zero-ordered energy volume 21, the audio encoding device 10A outputs a one, which controls the gate 110. When the result of this multiplication is less than the zero-ordered energy volume 21, the audio encoding device 10A outputs a zero, which again controls the gate 110. The gate 110 controls whether non-zero ordered ones of SHC 11A are included in the compacted HOA content 112, which is another way of referring to the reduced set of SHC 11A (and also denoted as SHC 11B in the example of FIG. 4A). As shown in the example of FIG. 14, the ones and zeros to control the gate 110 also form the so-called "compaction bitmask," which is another way of referring to the bitmask 25 shown in the example of FIG. 4A.

FIG. 15 is a flowchart illustrating exemplary operation of an audio encoding device, such as the audio encoding device 10B shown in the example of FIG. 4B, in performing various aspects of the techniques described in this disclosure. FIG. 15 represents another way by which to diagram the operations performed by the audio compression unit 12 of the audio encoding devices 10B and 10C. As shown in the example of FIG. 15, the audio compression unit 12 may receive a baseline threshold 35, which the audio compression unit 12 may use when dynamically determining the threshold 23 in the manner described above.

The audio compression unit 12 may also receive the SHC 11A (which is denoted as "HOA content" in the example of FIG. 15). The audio compression unit 12 may apply a transform 30 to transform the SHC 11A from the time domain to the frequency domain (generating SHC 11A'). The audio compression unit 12 of the audio encoding device 10B may perform this transform and include the transformed version of the SHC 11A (or, in other words, SHC 11A) or a derivative thereof in the bitstream, while the audio compression unit 12 of the audio encoding device 10C may not perform this transform, including the SHC 11A (or a derivative thereof) in the bitstream. In this way, a single audio compression unit 12 may implement both techniques by providing for a configurable switch 12 by which to select a frequency dependent or independent thresholding.

The audio compression unit 12 may also perform the above described energy analysis 20A on the zero-order ones of the SHC 11A' and the above described energy analysis 20B on the non-zero-order ones of the SHC 11A', where smoothing may be applied to the energy volumes 21 output as a result of these energy analysis 20. The audio compression unit 12 may apply the threshold 23 to these energy volumes 21 in the manner described above to generate the bitmask 25. The bitmask 25 may be output to the fade unit 36, which may apply the fade function to the non-zero-ordered ones of the SHC 11A' or the SHC 11A depending on whether frequency dependent or independent thresholding has been configured. The gate 110 may also be controlled by this bitmask 25 to include or eliminate non-zero-ordered ones of the SHC 11A' or the SHC 11A again depending on whether frequency dependent or independent thresholding has been configured.

In this respect, an audio coding device, e.g., the audio encoding devices 10A-10C shown in examples FIGS. 4A-4C and/or the audio decoding device 40, may be configured or otherwise representative of the device or apparatus configured to perform the techniques set forth in the following clauses:

Clause 1

A method of compressing multi-channel audio data comprising:

performing an energy analysis with respect to a plurality of spherical harmonic coefficients to determine a reduced version of the plurality of spherical harmonic coefficients.

Clause 2

The method of clause 1, wherein performing the energy analysis comprises:

performing the energy analysis with respect to the plurality of spherical harmonic coefficients to determine at least one energy volume, wherein at least one of the plurality of spherical harmonic coefficients has an order greater than one; and applying a threshold to the at least one energy volume to generate the reduced version of the plurality of spherical harmonic.

Clause 3

The method of clause 1, further comprising generating a bitstream based on the reduced version of the plurality of spherical harmonic coefficients.

Clause 4

The method of clause 1, wherein performing the energy analysis comprises performing an energy analysis with respect to each combination of an order and a sub-order to which the plurality of spherical harmonic coefficients correspond to generate an energy volume corresponding to each combination of the order and the sub-order.

Clause 5

The method of clause 1, wherein performing the energy analysis comprises:

performing an energy analysis with respect to each combination of an order and a sub-order to which the plurality of spherical harmonic coefficients correspond to generate an energy volume corresponding to each combination of the order and the sub-order; and applying a threshold to the energy volumes corresponding to each combination of the order and the sub-order to determine whether to eliminate the corresponding combination of the order and the sub-order of the plurality of spherical harmonic coefficients; and eliminating those of the plurality of the spherical harmonic coefficients corresponding to the combination of the order and the sub-order based on the determinations to generate the reduced version to the plurality of the spherical harmonic coefficients.

Clause 6

The method of clauses 2 or 5, wherein applying the threshold comprises:

multiplying the at least one energy volume associated with those of the plurality of spherical harmonic coefficients having an order greater than one by the threshold to determine at least one comparison energy volume;

determining whether the at least one comparison energy volume is greater than the at least one energy volume associated with the one of the plurality of spherical harmonic coefficients having an order equal to zero; and eliminating one or more of the plurality of spherical harmonic coefficients having an order greater than one based on the determination.

Clause 7

The method of clauses 2 or 5, further comprising applying a smoothing function to the at least one energy volume to generate at least one smoothed energy volume, wherein applying the threshold comprises applying the threshold to the at least one smoothed energy volume to generate the reduced version of the plurality of spherical harmonic coefficients.

Clause 8

The method of clause 1, further comprising generating a bitmask to identify the ones of the plurality of spherical harmonic coefficients included and eliminated from the reduced version of the plurality of spherical harmonic coefficients.

Clause 9

The method of clause 1, further comprising:

generating a bitmask to identify the ones of the plurality of spherical harmonic coefficients included and eliminated from the reduced version of the plurality of spherical harmonic coefficients; and generating a bitstream to include the bitmask and the reduced version of the plurality of spherical harmonic coefficients.

Clause 10

The method of clause 1, further comprising:

audio encoding the reduced version of the plurality of spherical harmonic coefficients in accordance with an audio encoding scheme to generate encoded audio data; and generating a bitstream to include the encoded audio data.

Clause 11

The method of clause 10, wherein the audio encoding scheme comprise an advanced audio encoding (AAC) scheme.

Clause 12

The method of clause 1, wherein the reduced version of the plurality of spherical harmonic coefficients have at least one of the spherical harmonic coefficients eliminated from the plurality of spherical harmonic coefficients.

Clause 13

A device comprising:

one or more processors configured to perform an energy analysis with respect to a plurality of spherical harmonic coefficients to determine a reduced version of the plurality of spherical harmonic coefficients.

Clause 14

The device of clause 13, wherein the one or more processors are further configured to, when performing the energy analysis, perform the energy analysis with respect to the plurality of spherical harmonic coefficients to determine at least one energy volume, wherein at least one of the plurality of spherical harmonic coefficients has an order greater than one, and apply a threshold to the at least one energy volume to generate the reduced version of the plurality of spherical harmonic.

Clause 15

The device of clause 13, wherein the one or more processors are further configured to generate a bitstream based on the reduced version of the plurality of spherical harmonic coefficients.

Clause 16

The device of clause 13, wherein the one or more processors are further configured to, when performing the energy analysis, perform the energy analysis with respect to each combination of an order and a sub-order to which the plurality of spherical harmonic coefficients correspond to generate an energy volume corresponding to each combination of the order and the sub-order.

Clause 17

The device of clause 13, wherein the one or more processors are further configured to, when performing the energy analysis, perform an energy analysis with respect to each combination of an order and a sub-order to which the plurality of spherical harmonic coefficients correspond to generate an energy volume corresponding to each combination of the order and the sub-order, and apply a threshold to the energy volumes corresponding to each combination of the order and the sub-order to determine whether to eliminate the corresponding combination of the order and the sub-order of the plurality of spherical harmonic coefficients, and eliminate those of the plurality of the spherical harmonic coefficients corresponding to the combination of the order and the sub-order based on the determinations to generate the reduced version to the plurality of the spherical harmonic coefficients.

Clause 18

The device of clauses 14 or 17, wherein the one or more processors are further configured to, when applying the threshold, multiply the at least one energy volume associated with those of the plurality of spherical harmonic coefficients having an order greater than one by the threshold to determine at least one comparison energy volume, determine whether the at least one comparison energy volume is greater than the at least one energy volume associated with the one of the plurality of spherical harmonic coefficients having an order equal to zero, and eliminate one or more of the plurality of spherical harmonic coefficients having an order greater than one based on the determination.

Clause 19

The device of clauses 14 or 17, wherein the one or more processors are further configured to apply a smoothing function to the at least one energy volume to generate at least one smoothed energy volume, and when applying the threshold, apply the threshold to the at least one smoothed energy volume to generate the reduced version of the plurality of spherical harmonic coefficients.

Clause 20

The device of clause 13, wherein the one or more processors are further configured to generate a bitmask to identify the ones of the plurality of spherical harmonic coefficients included and eliminated from the reduced version of the plurality of spherical harmonic coefficients.

Clause 21

The device of clause 13, wherein the one or more processors are further configured to generate a bitmask to identify the ones of the plurality of spherical harmonic coefficients included and eliminated from the reduced version of the plurality of spherical harmonic coefficients, and generate a bitstream to include the bitmask and the reduced version of the plurality of spherical harmonic coefficients.

Clause 22

The device of clause 13, wherein the one or more processors are further configured to audio encode the reduced version of the plurality of spherical harmonic coefficients in accordance with an audio encoding scheme to generate encoded audio data, and generate a bitstream to include the encoded audio data.

Clause 23

The device of clause 22, wherein the audio encoding scheme comprise an advanced audio encoding (AAC) scheme.

Clause 24

The device of clause 13, wherein the reduced version of the plurality of spherical harmonic coefficients have at least one of the spherical harmonic coefficients eliminated from the plurality of spherical harmonic coefficients.

Clause 25

A device comprising:

means for performing an energy analysis with respect to a plurality of spherical harmonic coefficients to determine a reduced version of the plurality of spherical harmonic coefficients.

Clause 26

The device of clause 25, wherein the means for performing the energy analysis comprise:

means for performing the energy analysis with respect to the plurality of spherical harmonic coefficients to determine at least one energy volume, wherein at least one of the plurality of spherical harmonic coefficients has an order greater than one; and means for applying a threshold to the at least one energy volume to generate the reduced version of the plurality of spherical harmonic.

Clause 27

The device of clause 25, further comprising means for generating a bitstream based on the reduced version of the plurality of spherical harmonic coefficients.

Clause 28

The device of clause 25, wherein the means for performing the energy analysis comprises means for performing an energy analysis with respect to each combination of an order and a sub-order to which the plurality of spherical harmonic coefficients correspond to generate an energy volume corresponding to each combination of the order and the sub-order.

Clause 29

The device of clause 25, wherein the means for performing the energy analysis comprises:

means for performing an energy analysis with respect to each combination of an order and a sub-order to which the plurality of spherical harmonic coefficients correspond to generate an energy volume corresponding to each combination of the order and the sub-order; and means for applying a threshold to the energy volumes corresponding to each combination of the order and the sub-order to determine whether to eliminate the corresponding combination of the order and the sub-order of the plurality of spherical harmonic coefficients; and means for eliminating those of the plurality of the spherical harmonic coefficients corresponding to the combination of the order and the sub-order based on the determinations to generate the reduced version to the plurality of the spherical harmonic coefficients.

Clause 30

The device of clauses 26 and 29, wherein the means for applying the threshold comprises:

means for multiplying the at least one energy volume associated with those of the plurality of spherical harmonic coefficients having an order greater than one by the threshold to determine at least one comparison energy volume;

means for determining whether the at least one comparison energy volume is greater than the at least one energy volume associated with the one of the plurality of spherical harmonic coefficients having an order equal to zero; and means for eliminating one or more of the plurality of spherical harmonic coefficients having an order greater than one based on the determination.

Clause 31

The device of clauses 26 and 29, further comprising means for applying a smoothing function to the at least one energy volume to generate at least one smoothed energy volume, wherein the means for applying the threshold comprises means for applying the threshold to the at least one smoothed energy volume to generate the reduced version of the plurality of spherical harmonic coefficients.

Clause 32

The device of clause 25, further comprising means for generating a bitmask to identify the ones of the plurality of spherical harmonic coefficients included and eliminated from the reduced version of the plurality of spherical harmonic coefficients.

Clause 33

The device of clause 25, further comprising:

means for generating a bitmask to identify the ones of the plurality of spherical harmonic coefficients included and eliminated from the reduced version of the plurality of spherical harmonic coefficients; and means for generating a bitstream to include the bitmask and the reduced version of the plurality of spherical harmonic coefficients.

Clause 34

The device of clause 25, further comprising:

means for audio encoding the reduced version of the plurality of spherical harmonic coefficients in accordance with an audio encoding scheme to generate encoded audio data; and means for generating a bitstream to include the encoded audio data.

Clause 35

The device of clause 34, wherein the audio encoding scheme comprise an advanced audio encoding (AAC) scheme.

Clause 36

The device of clause 25, wherein the reduced version of the plurality of spherical harmonic coefficients have at least one of the spherical harmonic coefficients eliminated from the plurality of spherical harmonic coefficients.

Clause 37

A non-transitory computer-readable storage medium having stored thereon instructions that, when executed, cause one or more processors to:

perform an energy analysis with respect to a plurality of spherical harmonic coefficients to determine a reduced version of the plurality of spherical harmonic coefficients.

Clause 1A

A method of compressing audio data, the method comprising:

performing an energy analysis with respect to a plurality of spherical harmonic coefficients to determine at least one energy volume, wherein at least one of the plurality of spherical harmonic coefficients has an order greater than one;

dynamically determining at least one threshold based on the plurality of the spherical harmonic coefficients;

applying the dynamically determined at least one threshold to the at least one energy volume to generate a reduced version of the plurality of spherical harmonic coefficients; and generating a bitstream based on the reduced version of the plurality of spherical harmonic coefficients.

Clause 2A

The method of clause 1A, wherein dynamically determining the at least one threshold comprises dynamically determining the at least one threshold based on a diffusion analysis of at least those of the plurality of spherical harmonic coefficients having an order equal to zero and an order equal to one.

Clause 3A

The method of clause 1A, wherein dynamically determining the at least one threshold comprises dynamically determining the at least one threshold on a per order basis for the plurality of spherical harmonic coefficients.

Clause 4A

The method of clause 1A, wherein dynamically determining the at least one threshold comprises dynamically determining the at least one threshold on a per sub-order basis for the plurality of spherical harmonic coefficients.

Clause 5A

The method of clause 1A, wherein dynamically determining the at least one threshold comprises dynamically determining the at least one threshold on an order and a sub-order basis for the plurality of spherical harmonic coefficients.

Clause 6A

The method of clause 1A, further comprising transforming the plurality of spherical harmonic coefficients from a time domain to a frequency domain to generate a transformed plurality of spherical harmonic coefficients, wherein dynamically determining the at least one threshold comprises dynamically determining the at least one threshold on a per frequency bin basis for the transformed plurality of spherical harmonic coefficients.

Clause 7A

The method of clause 1A, further comprising transforming the plurality of spherical harmonic coefficients from a time domain to a frequency domain to generate a transformed plurality of spherical harmonic coefficients, wherein applying the dynamically determined at least one threshold comprises applying the dynamically determined at least one threshold to the at least one energy volume to generate a reduced version of the transformed plurality of spherical harmonic coefficients having at least one of the spherical harmonic coefficients eliminated from the transformed plurality of spherical harmonic coefficients.

Clause 8A

The method of clause 1A, further comprising, prior to performing the energy analysis and applying the dynamically determined at least one threshold, transforming the plurality of spherical harmonic coefficients from a time domain to a frequency domain to generate a transformed plurality of spherical harmonic coefficients.

Clause 9A

The method of clause 1A, wherein performing the energy analysis comprises:

performing an energy analysis with respect to those of the plurality of spherical harmonic coefficients having an order equal to zero to determine a zero-order energy volume; and performing an energy analysis with respect to those of the plurality of spherical harmonic coefficients having an order greater than zero to determine non-zero-order energy volumes.

Clause 10A

The method of clause 1A, wherein performing the energy analysis comprises performing an energy analysis with respect to each combination of an order and a sub-order to which the plurality of spherical harmonic coefficients correspond to generate an energy volume corresponding to each combination of the order and the sub-order, wherein applying the dynamically determined at least one threshold comprises:

applying the threshold to the energy volumes corresponding to each combination of the order and the sub-order to determine whether to eliminate the corresponding combination of the order and the sub-order of the plurality of spherical harmonic coefficients; and eliminating those of the plurality of the spherical harmonic coefficients corresponding to the combination of the order and the sub-order based on the determinations to generate the reduced version to the plurality of the spherical harmonic coefficients.

Clause 11A

The method of clause 1A, wherein applying the dynamically determined at least one threshold comprises:

multiplying the at least one energy volume associated with those of the plurality of spherical harmonic coefficients having an order greater than one by the dynamically determined at least one threshold to determine at least one comparison energy volume;

determining whether the at least one comparison energy volume is greater than the at least one energy volume associated with the one of the plurality of spherical harmonic coefficients having an order equal to zero; and eliminating one or more of the plurality of spherical harmonic coefficients having an order greater than one based on the determination.

Clause 12A

The method of clause 1A, further comprising applying a smoothing function to the at least one energy volume to generate at least one smoothed energy volume, wherein applying the dynamically determined at least one threshold comprises applying the dynamically determined at least one threshold to the at least one smoothed energy volume to generate the reduced version of the plurality of spherical harmonic coefficients.

Clause 13A

The method of clause 1A, further comprising generating a bitmask to identify the ones of the plurality of spherical harmonic coefficients included and eliminated from the reduced version of the plurality of spherical harmonic coefficients.

Clause 14A

The method of clause 1A, further comprising generating a bitmask to identify the ones of the plurality of spherical harmonic coefficients included and eliminated from the reduced version of the plurality of spherical harmonic coefficients, wherein generating the bitstream further comprises generating the bitstream to include the bitmask.

Clause 15A

The method of clause 1A, further comprising audio encoding the reduced version of the plurality of spherical harmonic coefficients in accordance with an audio encoding scheme to generate encoded audio data, wherein generating the bitstream further comprises generating the bitstream to include the encoded audio data.

Clause 16A

The method of clause 15A, wherein the audio encoding scheme comprise an advanced audio encoding (AAC) scheme.

Clause 17A

The method of clause 1A, further comprising applying a fading function to the plurality of spherical harmonic coefficients when generating the reduced version of the plurality of spherical harmonic coefficients.

Clause 18A

The method of clause 1A, wherein the reduced version of the plurality of spherical harmonic coefficients have at least one of the spherical harmonic coefficients eliminated from the plurality of spherical harmonic coefficients.

Clause 19A

A device comprising:

one or more processors configured to perform an energy analysis with respect to a plurality of spherical harmonic coefficients to determine at least one energy volume, wherein at least one of the plurality of spherical harmonic coefficients has an order greater than one, dynamically determine at least one threshold based on the plurality of the spherical harmonic coefficients, apply the dynamically determined at least one threshold to the at least one energy volume to generate a reduced version of the plurality of spherical harmonic, and generate a bitstream based on the reduced version of the plurality of spherical harmonic coefficients.

Clause 20A

The device of clause 19A, wherein the one or more processors are further configured to, when dynamically determining the at least one threshold, dynamically determine the at least one threshold based on a diffusion analysis of at least those of the plurality of spherical harmonic coefficients having an order equal to zero and an order equal to one.

Clause 21A

The device of clause 19A, wherein the one or more processors are further configured to, when dynamically determining the at least one threshold, dynamically determine the at least one threshold on a per order basis for the plurality of spherical harmonic coefficients.

Clause 22A

The device of clause 19A, wherein the one or more processors are further configured to, when dynamically determining the at least one threshold, dynamically determine the at least one threshold on a per sub-order basis for the plurality of spherical harmonic coefficients.

Clause 23A

The device of clause 19A, wherein the one or more processors are further configured to, when dynamically determining the at least one threshold, dynamically determine the at least one threshold on an order and a sub-order basis for the plurality of spherical harmonic coefficients.

Clause 24A

The device of clause 19A, wherein the one or more processors are further configured to transform the plurality of spherical harmonic coefficients from a time domain to a frequency domain to generate a transformed plurality of spherical harmonic coefficients, and wherein the one or more processors are further configured to, when dynamically determining the at least one threshold, dynamically determine the at least one threshold on a per frequency bin basis for the transformed plurality of spherical harmonic coefficients.

Clause 25A

The device of clause 19A, wherein the one or more processors are further configured to transform the plurality of spherical harmonic coefficients from a time domain to a frequency domain to generate a transformed plurality of spherical harmonic coefficients, and wherein the one or more processors are further configured to, when applying the dynamically determined at least one threshold, apply the dynamically determined at least one threshold to the at least one energy volume to generate a reduced version of the transformed plurality of spherical harmonic coefficients having at least one of the spherical harmonic coefficients eliminated from the transformed plurality of spherical harmonic coefficients.

Clause 26A

The device of clause 19A, wherein the one or more processors are further configured to, prior to performing the energy analysis and applying the dynamically determined at least one threshold, transform the plurality of spherical harmonic coefficients from a time domain to a frequency domain to generate a transformed plurality of spherical harmonic coefficients.

Clause 27A

The device of clause 19A, wherein the one or more processors are further configured to, when performing the energy analysis, perform an energy analysis with respect to those of the plurality of spherical harmonic coefficients having an order equal to zero to determine a zero-order energy volume, and perform an energy analysis with respect to those of the plurality of spherical harmonic coefficients having an order greater than zero to determine non-zero-order energy volumes.

Clause 28A

The device of clause 19A, wherein the one or more processors are further configured to, when performing the energy analysis, perform an energy analysis with respect to each combination of an order and a sub-order to which the plurality of spherical harmonic coefficients correspond to generate an energy volume corresponding to each combination of the order and the sub-order, and wherein the one or more processors are further configured to, when applying the dynamically determined at least one threshold, apply the threshold to the energy volumes corresponding to each combination of the order and the sub-order to determine whether to eliminate the corresponding combination of the order and the sub-order of the plurality of spherical harmonic coefficients, and eliminate those of the plurality of the spherical harmonic coefficients corresponding to the combination of the order and the sub-order based on the determinations to generate the reduced version to the plurality of the spherical harmonic coefficients.

Clause 29A

The device of clause 19A, wherein the one or more processors are further configured to, when applying the dynamically determined at least one threshold, multiply the at least one energy volume associated with those of the plurality of spherical harmonic coefficients having an order greater than one by the dynamically determined at least one threshold to determine at least one comparison energy volume, determine whether the at least one comparison energy volume is greater than the at least one energy volume associated with the one of the plurality of spherical harmonic coefficients having an order equal to zero, and eliminate one or more of the plurality of spherical harmonic coefficients having an order greater than one based on the determination.

Clause 30A

The device of clause 19A, wherein the one or more processors are further configured to apply a smoothing function to the at least one energy volume to generate at least one smoothed energy volume, and wherein the one or more processors are further configured to, when applying the dynamically determined at least one threshold, apply the dynamically determined at least one threshold to the at least one smoothed energy volume to generate the reduced version of the plurality of spherical harmonic coefficients.

Clause 31A

The device of clause 19A, wherein the one or more processors are further configured to generate a bitmask to identify the ones of the plurality of spherical harmonic coefficients included and eliminated from the reduced version of the plurality of spherical harmonic coefficients.

Clause 32A

The device of clause 19A, wherein the one or more processors are further configured to generate a bitmask to identify the ones of the plurality of spherical harmonic coefficients included and eliminated from the reduced version of the plurality of spherical harmonic coefficients, and wherein the one or more processors are further configured to, when generating the bitstream, generate the bitstream to include the bitmask.

Clause 33A

The device of clause 19A, wherein the one or more processors are further configured to audio encode the reduced version of the plurality of spherical harmonic coefficients in accordance with an audio encoding scheme to generate encoded audio data, and wherein the one or more processors are further configured to, when generating the bitstream, generate the bitstream to include the encoded audio data.

Clause 34A

The device of clause 33A, wherein the audio encoding scheme comprise an advanced audio encoding (AAC) scheme.

Clause 35A

The device of clause 19A, wherein the one or more processors are further configured to apply a fading function to the plurality of spherical harmonic coefficients when generating the reduced version of the plurality of spherical harmonic coefficients.

Clause 36A

The device of clause 19A, wherein the reduced version of the plurality of spherical harmonic coefficients have at least one of the spherical harmonic coefficients eliminated from the plurality of spherical harmonic coefficients.

Clause 37A

A device comprising:

means for performing an energy analysis with respect to a plurality of spherical harmonic coefficients to determine at least one energy volume, wherein at least one of the plurality of spherical harmonic coefficients has an order greater than one;

means for dynamically determining at least one threshold based on the plurality of the spherical harmonic coefficients;

means for applying the dynamically determined at least one threshold to the at least one energy volume to generate a reduced version of the plurality of spherical harmonic coefficients; and means for generating a bitstream based on the reduced version of the plurality of spherical harmonic coefficients.

Clause 38A

The device of clause 37A, wherein the means for dynamically determining the at least one threshold comprises means for dynamically determining the at least one threshold based on a diffusion analysis of at least those of the plurality of spherical harmonic coefficients having an order equal to zero and an order equal to one.

Clause 39A

The device of clause 37A, wherein the means for dynamically determining the at least one threshold comprises means for dynamically determining the at least one threshold on a per order basis for the plurality of spherical harmonic coefficients.

Clause 40A

The device of clause 37A, wherein the means for dynamically determining the at least one threshold comprises means for dynamically determining the at least one threshold on a per sub-order basis for the plurality of spherical harmonic coefficients.

Clause 41A

The device of clause 37A, wherein the means for dynamically determining the at least one threshold comprises means for dynamically determining the at least one threshold on an order and a sub-order basis for the plurality of spherical harmonic coefficients.

Clause 42A

The device of clause 37A, further comprising means for transforming the plurality of spherical harmonic coefficients from a time domain to a frequency domain to generate a transformed plurality of spherical harmonic coefficients, wherein the means for dynamically determining the at least one threshold comprises means for dynamically determining the at least one threshold on a per frequency bin basis for the transformed plurality of spherical harmonic coefficients.

Clause 43A

The device of clause 37A, further comprising means for transforming the plurality of spherical harmonic coefficients from a time domain to a frequency domain to generate a transformed plurality of spherical harmonic coefficients, wherein the means for applying the dynamically determined at least one threshold comprises means for applying the dynamically determined at least one threshold to the at least one energy volume to generate a reduced version of the transformed plurality of spherical harmonic coefficients having at least one of the spherical harmonic coefficients eliminated from the transformed plurality of spherical harmonic coefficients.

Clause 44A

The device of clause 37A, further comprising means for, prior to performing the energy analysis and applying the dynamically determined at least one threshold, transforming the plurality of spherical harmonic coefficients from a time domain to a frequency domain to generate a transformed plurality of spherical harmonic coefficients.

Clause 45A

The device of clause 37A, wherein the means for performing the energy analysis comprises:

means for performing an energy analysis with respect to those of the plurality of spherical harmonic coefficients having an order equal to zero to determine a zero-order energy volume; and means for performing an energy analysis with respect to those of the plurality of spherical harmonic coefficients having an order greater than zero to determine non-zero-order energy volumes.

Clause 46A

The device of clause 37A, wherein the means for performing the energy analysis comprises means for performing an energy analysis with respect to each combination of an order and a sub-order to which the plurality of spherical harmonic coefficients correspond to generate an energy volume corresponding to each combination of the order and the sub-order, wherein the means for applying the dynamically determined at least one threshold comprises:

means for applying the threshold to the energy volumes corresponding to each combination of the order and the sub-order to determine whether to eliminate the corresponding combination of the order and the sub-order of the plurality of spherical harmonic coefficients; and means for eliminating those of the plurality of the spherical harmonic coefficients corresponding to the combination of the order and the sub-order based on the determinations to generate the reduced version to the plurality of the spherical harmonic coefficients.

Clause 47A

The device of clause 37A, wherein the means for applying the dynamically determined at least one threshold comprises:

means for multiplying the at least one energy volume associated with those of the plurality of spherical harmonic coefficients having an order greater than one by the dynamically determined at least one threshold to determine at least one comparison energy volume;

means for determining whether the at least one comparison energy volume is greater than the at least one energy volume associated with the one of the plurality of spherical harmonic coefficients having an order equal to zero; and means for eliminating one or more of the plurality of spherical harmonic coefficients having an order greater than one based on the determination.

Clause 48A

The device of clause 37A, further comprising means for applying a smoothing function to the at least one energy volume to generate at least one smoothed energy volume, wherein the means for applying the dynamically determined at least one threshold comprises means for applying the dynamically determined at least one threshold to the at least one smoothed energy volume to generate the reduced version of the plurality of spherical harmonic coefficients.

Clause 49A

The device of clause 37A, further comprising means for generating a bitmask to identify the ones of the plurality of spherical harmonic coefficients included and eliminated from the reduced version of the plurality of spherical harmonic coefficients.

Clause 50A

The device of clause 37A, further comprising means for generating a bitmask to identify the ones of the plurality of spherical harmonic coefficients included and eliminated from the reduced version of the plurality of spherical harmonic coefficients, wherein the means for generating the bitstream further comprises means for generating the bitstream to include the bitmask.

Clause 51A

The device of clause 37A, further comprising means for audio encoding the reduced version of the plurality of spherical harmonic coefficients in accordance with an audio encoding scheme to generate encoded audio data, wherein the means for generating the bitstream further comprises means for generating the bitstream to include the encoded audio data.

Clause 52A

The device of clause 51A, wherein the audio encoding scheme comprise an advanced audio encoding (AAC) scheme.

Clause 53A

The device of clause 37A, further comprising means for applying a fading function to the plurality of spherical harmonic coefficients when generating the reduced version of the plurality of spherical harmonic coefficients.

Clause 54A

The device of clause 37A, wherein the reduced version of the plurality of spherical harmonic coefficients have at least one of the spherical harmonic coefficients eliminated from the plurality of spherical harmonic coefficients.

Clause 55A

A non-transitory computer-readable storage medium having stored thereon instructions that, when executed, cause one or more processors to:

perform an energy analysis with respect to a plurality of spherical harmonic coefficients to determine at least one energy volume, wherein at least one of the plurality of spherical harmonic coefficients has an order greater than one;

dynamically determine at least one threshold based on the plurality of the spherical harmonic coefficients;

apply the dynamically determined at least one threshold to the at least one energy volume to generate a reduced version of the plurality of spherical harmonic coefficients; and generate a bitstream based on the reduced version of the plurality of spherical harmonic coefficients.

Clause 1B

A method of compressing audio data comprising:

for a sliding window of time, dynamically determining a plurality of thresholds for the audio data that includes samples of spherical harmonic coefficients; and applying the dynamically determined thresholds to the spherical harmonic coefficients for the sliding window of time so as to generate a reduced set of the spherical harmonic coefficients.

Clause 2B

The method of clause 1B, wherein the sliding window of time comprises an audio frame, and wherein dynamically determining the thresholds comprises dynamically determining the thresholds on a frame-by-frame basis for the audio data that includes the samples of the spherical harmonic coefficients.

Clause 3B

The method of clause 1B, wherein the sliding window of time represents a larger window of time for those of the spherical harmonic coefficients having an lower order and a relatively smaller window of time for those of the spherical harmonic coefficients having a higher order.

Clause 4B

The method of clause 1B, wherein the spherical harmonic coefficients include at least one spherical harmonic coefficient having an order greater than one.

Clause 5B

The method of clause 1B, further comprising performing an energy analysis with respect to the spherical harmonic coefficients to determine at least one energy volume.

Clause 6B

The method of clause 5B, wherein applying the dynamically determined thresholds comprises:

multiplying the at least one energy volume associated with those of the spherical harmonic coefficients having an order greater than one by the dynamically determined thresholds to determine at least one comparison energy volume;

determining whether the at least one comparison energy volume is greater than the at least one energy volume associated with the one of the spherical harmonic coefficients having an order equal to zero; and eliminating one or more of the spherical harmonic coefficients having an order greater than one based on the determination.

Clause 7B

The method of clause 1B, wherein the reduced set of the plurality of spherical harmonic coefficients does not include at least one of the spherical harmonic coefficients present in the samples of the spherical harmonic coefficients.

Clause 8B

A device comprising:

one or more processor configured to, for a sliding window of time, dynamically determine a plurality of thresholds for the audio data that includes samples of spherical harmonic coefficients, and apply the dynamically determined thresholds to the spherical harmonic coefficients for the sliding window of time so as to generate a reduced set of the spherical harmonic coefficients.

Clause 9B

The device of clause 8B, wherein the sliding window of time comprises an audio frame, and wherein the one or more processors are further configured to, when dynamically determining the thresholds, dynamically determine the thresholds on a frame-by-frame basis for the audio data that includes the samples of the spherical harmonic coefficients.

Clause 10B

The device of clause 8B, wherein the sliding window of time represents a larger window of time for those of the spherical harmonic coefficients having an lower order and a relatively smaller window of time for those of the spherical harmonic coefficients having a higher order.

Clause 11B

The device of clause 8B, wherein the spherical harmonic coefficients include at least one spherical harmonic coefficient having an order greater than one.

Clause 12B

The device of clause 8B, wherein the one or more processors are further configured to perform an energy analysis with respect to the spherical harmonic coefficients to determine at least one energy volume.

Clause 13B

The device of clause 12B, wherein the one or more processors are further configured to, when applying the dynamically determined thresholds, multiply the at least one energy volume associated with those of the spherical harmonic coefficients having an order greater than one by the dynamically determined thresholds to determine at least one comparison energy volume, determine whether the at least one comparison energy volume is greater than the at least one energy volume associated with the one of the spherical harmonic coefficients having an order equal to zero, and eliminate one or more of the spherical harmonic coefficients having an order greater than one based on the determination.

Clause 14B

The device of clause 8B, wherein the reduced set of the plurality of spherical harmonic coefficients does not include at least one of the spherical harmonic coefficients present in the samples of the spherical harmonic coefficients.

Clause 15B

A device comprising:

means for dynamically determining, for a sliding window of time, a plurality of thresholds for the audio data that includes samples of spherical harmonic coefficients;

means for applying the dynamically determined thresholds to the spherical harmonic coefficients for the sliding window of time so as to generate a reduced set of the spherical harmonic coefficients.

Clause 16B

The device of clause 15B, wherein the sliding window of time comprises an audio frame, and wherein the means for dynamically determining the thresholds comprises means for dynamically determining the thresholds on a frame-by-frame basis for the audio data that includes the samples of the spherical harmonic coefficients.

Clause 17B

The device of clause 15B, wherein the sliding window of time represents a larger window of time for those of the spherical harmonic coefficients having an lower order and a relatively smaller window of time for those of the spherical harmonic coefficients having a higher order.

Clause 18B

The device of clause 15B, wherein the spherical harmonic coefficients include at least one spherical harmonic coefficient having an order greater than one.

Clause 19B

The device of clause 15B, further comprising means for performing an energy analysis with respect to the spherical harmonic coefficients to determine at least one energy volume.

Clause 20B

The device of clause 19B, wherein the means for applying the dynamically determined thresholds comprises:

means for multiplying the at least one energy volume associated with those of the spherical harmonic coefficients having an order greater than one by the dynamically determined thresholds to determine at least one comparison energy volume;

means for determining whether the at least one comparison energy volume is greater than the at least one energy volume associated with the one of the spherical harmonic coefficients having an order equal to zero; and means for eliminating one or more of the spherical harmonic coefficients having an order greater than one based on the determination.

Clause 21B

The device of clause 15B, wherein the reduced set of the plurality of spherical harmonic coefficients does not include at least one of the spherical harmonic coefficients present in the samples of the spherical harmonic coefficients.

Clause 22B

A non-transitory computer-readable storage medium having stored thereon instructions that, when executed, cause one or more processors to:

for a sliding window of time, dynamically determine a plurality of thresholds for the audio data that includes samples of spherical harmonic coefficients;

apply the dynamically determined thresholds to the spherical harmonic coefficients for the sliding window of time so as to generate a reduced set of the spherical harmonic coefficients.

Clause 1C

A method of compressing audio data comprising:

applying a plurality of thresholds dynamically determined on a per order basis to audio data that includes samples of spherical harmonic coefficients a plurality of spherical harmonic coefficients in order to generate a reduced set of the spherical harmonic coefficients.

Clause 2C

The method of clause 1C, further comprising dynamically determining a corresponding one of the plurality of thresholds for each combination of order and sub-order of the spherical harmonic coefficients except for those of the spherical harmonic coefficients having an order and sub-order of zero, wherein a maximum order of the spherical harmonic coefficients is four.

Clause 3C

The method of clause 1C, further comprising dynamically determining, for a sliding window of time, the plurality of thresholds on a per order basis for the spherical harmonic coefficients.

Clause 4C

The method of clause 3C, wherein the sliding window of time represents a larger window of time for those of the spherical harmonic coefficients having an lower order and a relatively smaller window of time for those of the spherical harmonic coefficients having a higher order.

Clause 5C

The method of clause 1C, wherein the spherical harmonic coefficients include at least one spherical harmonic coefficient having an order greater than one.

Clause 6C

The method of clause 1C, further comprising performing an energy analysis with respect to the spherical harmonic coefficients to determine at least one energy volume.

Clause 7C

The method of clause 6C, wherein applying the plurality of thresholds comprises:

multiplying the at least one energy volume associated with those of the spherical harmonic coefficients having an order greater than one by the dynamically determined thresholds to determine at least one comparison energy volume;

determining whether the at least one comparison energy volume is greater than the at least one energy volume associated with the one of the spherical harmonic coefficients having an order equal to zero; and eliminating one or more of the spherical harmonic coefficients having an order greater than one based on the determination.

Clause 8C

The method of clause 1B, wherein the reduced set of the spherical harmonic coefficients does not include at least one of the spherical harmonic coefficients present in the samples of the spherical harmonic coefficients.

Clause 9C

A device comprising:

one or more processor configured to apply a plurality of thresholds dynamically determined on a per order basis to audio data that includes samples of spherical harmonic coefficients a plurality of spherical harmonic coefficients in order to generate a reduced set of the spherical harmonic coefficients.

Clause 10C

The device of clause 9C, further comprising dynamically determining a corresponding one of the plurality of thresholds for each combination of order and sub-order of the spherical harmonic coefficients except for those of the spherical harmonic coefficients having an order and sub-order of zero, wherein a maximum order of the spherical harmonic coefficients is four.

Clause 11C

The device of clause 9C, further comprising dynamically determining, for a sliding window of time, the plurality of thresholds on a per order basis for the spherical harmonic coefficients.

Clause 12C

The device of clause 11C, wherein the sliding window of time represents a larger window of time for those of the spherical harmonic coefficients having an lower order and a relatively smaller window of time for those of the spherical harmonic coefficients having a higher order.

Clause 13C

The device of clause 9C, wherein the spherical harmonic coefficients include at least one spherical harmonic coefficient having an order greater than one.

Clause 14C

The device of clause 9C, further comprising performing an energy analysis with respect to the spherical harmonic coefficients to determine at least one energy volume.

Clause 15C

The device of clause 14C, wherein applying the plurality of thresholds comprises:

multiplying the at least one energy volume associated with those of the spherical harmonic coefficients having an order greater than one by the dynamically determined thresholds to determine at least one comparison energy volume;

determining whether the at least one comparison energy volume is greater than the at least one energy volume associated with the one of the spherical harmonic coefficients having an order equal to zero; and eliminating one or more of the spherical harmonic coefficients having an order greater than one based on the determination.

Clause 16C

The device of clause 9B, wherein the reduced set of the spherical harmonic coefficients does not include at least one of the spherical harmonic coefficients present in the samples of the spherical harmonic coefficients.

Clause 17C

A device comprising:

means for applying a plurality of thresholds dynamically determined on a per order basis to audio data that includes samples of spherical harmonic coefficients a plurality of spherical harmonic coefficients in order to generate a reduced set of the spherical harmonic coefficients.

Clause 18C

The device of clause 17C, further comprising dynamically determining a corresponding one of the plurality of thresholds for each combination of order and sub-order of the spherical harmonic coefficients except for those of the spherical harmonic coefficients having an order and sub-order of zero, wherein a maximum order of the spherical harmonic coefficients is four.

Clause 19C

The device of clause 17C, further comprising dynamically determining, for a sliding window of time, the plurality of thresholds on a per order basis for the spherical harmonic coefficients.

Clause 20C

The device of clause 19C, wherein the sliding window of time represents a larger window of time for those of the spherical harmonic coefficients having an lower order and a relatively smaller window of time for those of the spherical harmonic coefficients having a higher order.

Clause 21C

The device of clause 17C, wherein the spherical harmonic coefficients include at least one spherical harmonic coefficient having an order greater than one.

Clause 22C

The device of clause 17C, further comprising performing an energy analysis with respect to the spherical harmonic coefficients to determine at least one energy volume.

Clause 23C

The device of clause 22C, wherein applying the plurality of thresholds comprises:

multiplying the at least one energy volume associated with those of the spherical harmonic coefficients having an order greater than one by the dynamically determined thresholds to determine at least one comparison energy volume;

determining whether the at least one comparison energy volume is greater than the at least one energy volume associated with the one of the spherical harmonic coefficients having an order equal to zero; and eliminating one or more of the spherical harmonic coefficients having an order greater than one based on the determination.

Clause 24C

The device of clause 17B, wherein the reduced set of the spherical harmonic coefficients does not include at least one of the spherical harmonic coefficients present in the samples of the spherical harmonic coefficients.

Clause 25C

A non-transitory computer-readable storage medium having stored thereon instructions that, when executed, cause one or more processors to:

dynamically determine a plurality of thresholds for the audio data that includes samples of spherical harmonic coefficients on a per order basis for the spherical harmonic coefficients; and apply the dynamically determined thresholds to the spherical harmonic coefficients so as to generate a reduced set of the spherical harmonic coefficients that does not include at least one of the spherical harmonic coefficients present in the samples of the spherical harmonic coefficients.

Clause 1D

A method of compressing audio data comprised of spherical harmonic coefficients, the method comprising:

applying at least one threshold to the spherical harmonic coefficients so as to generate a reduced set of the spherical harmonic coefficients, wherein the at least one threshold is dynamically determined based on a diffusion analysis of the spherical harmonic coefficients.

Clause 2D

The method of clause 1D, wherein the at least one threshold is dynamically determined based on a diffusion analysis of at least those of the spherical harmonic coefficients having an order equal to zero and an order equal to one.

Clause 3D

The method of clause 1D, wherein the at least one threshold is dynamically determined based on the diffusion analysis and on a per order basis for the spherical harmonic coefficients.

Clause 4D

The method of clause 3D, wherein the at least one threshold is dynamically determined for each combination of order and sub-order of the spherical harmonic coefficients except for those of the spherical harmonic coefficients having an order and sub-order of zero, wherein a maximum order of the spherical harmonic coefficients is four.

Clause 5D

The method of clause 1D, wherein the at least one threshold is dynamically determined, for a sliding window of time, based on the diffusion analysis.

Clause 6D

The method of clause 5D, wherein the sliding window of time represents a larger window of time for those of the spherical harmonic coefficients having an lower order and a relatively smaller window of time for those of the spherical harmonic coefficients having a higher order.

Clause 7D

The method of clause 1D, wherein the spherical harmonic coefficients include at least one spherical harmonic coefficient having an order greater than one.

Clause 8D

The method of clause 1D, further comprising performing an energy analysis with respect to the spherical harmonic coefficients to determine at least one energy volume.

Clause 9D

The method of clause 8D, wherein applying the at least one threshold comprises:

multiplying the at least one energy volume associated with those of the spherical harmonic coefficients having an order greater than one by the dynamically determined at least one threshold to determine at least one comparison energy volume;

determining whether the at least one comparison energy volume is greater than the at least one energy volume associated with the one of the spherical harmonic coefficients having an order equal to zero; and eliminating one or more of the spherical harmonic coefficients having an order greater than one based on the determination.

Clause 10D

The device of clause 1D, wherein the reduced set of the spherical harmonic coefficients does not include at least one of the spherical harmonic coefficients present in the samples of the spherical harmonic coefficients.

Clause 11D

A device comprising:

one or more processor configured to apply at least one threshold to spherical harmonic coefficients so as to generate a reduced set of the spherical harmonic coefficients, wherein the at least one threshold is dynamically determined based on a diffusion analysis of the spherical harmonic coefficients.

Clause 12D

The device of clause 11D, wherein the at least one threshold is dynamically determined based on a diffusion analysis of at least those of the spherical harmonic coefficients having an order equal to zero and an order equal to one.

Clause 13D

The device of clause 11D, wherein the at least one threshold is dynamically determined based on the diffusion analysis and on a per order basis for the spherical harmonic coefficients.

Clause 14D

The device of clause 13D, wherein the at least one threshold is dynamically determined for each combination of order and sub-order of the spherical harmonic coefficients except for those of the spherical harmonic coefficients having an order and sub-order of zero, wherein a maximum order of the spherical harmonic coefficients is four.

Clause 15D

The device of clause 11D, wherein the at least one threshold is dynamically determined, for a sliding window of time, based on the diffusion analysis.

Clause 16D

The device of clause 15D, wherein the sliding window of time represents a larger window of time for those of the spherical harmonic coefficients having an lower order and a relatively smaller window of time for those of the spherical harmonic coefficients having a higher order.

Clause 17D

The device of clause 11D, wherein the spherical harmonic coefficients include at least one spherical harmonic coefficient having an order greater than one.

Clause 18D

The device of clause 11D, wherein the one or more processors are further configured to perform an energy analysis with respect to the spherical harmonic coefficients to determine at least one energy volume.

Clause 19D

The device of clause 18D, wherein the one or more processors are further configured to, when applying the at least one threshold, multiply the at least one energy volume associated with those of the spherical harmonic coefficients having an order greater than one by the dynamically determined at least one threshold to determine at least one comparison energy volume, determine whether the at least one comparison energy volume is greater than the at least one energy volume associated with the one of the spherical harmonic coefficients having an order equal to zero, and eliminate one or more of the spherical harmonic coefficients having an order greater than one based on the determination.

Clause 20D

The device of clause 11D, wherein the reduced set of the spherical harmonic coefficients does not include at least one of the spherical harmonic coefficients present in the samples of the spherical harmonic coefficients.

Clause 21D

A device comprising:

means for applying at least one threshold to spherical harmonic coefficients so as to generate a reduced set of the spherical harmonic coefficients, wherein the at least one threshold is dynamically determined based on a diffusion analysis of the spherical harmonic coefficients.

Clause 22D

The device of clause 21D, wherein the at least one threshold is dynamically determined based on a diffusion analysis of at least those of the spherical harmonic coefficients having an order equal to zero and an order equal to one.

Clause 23D

The device of clause 21D, wherein the at least one threshold is dynamically determined based on the diffusion analysis and on a per order basis for the spherical harmonic coefficients.

Clause 24D

The device of clause 23D, wherein the at least one threshold is dynamically determined for each combination of order and sub-order of the spherical harmonic coefficients except for those of the spherical harmonic coefficients having an order and sub-order of zero, wherein a maximum order of the spherical harmonic coefficients is four.

Clause 25D

The device of clause 21D, wherein the at least one threshold is dynamically determined, for a sliding window of time, based on the diffusion analysis.

Clause 26D

The device of clause 25D, wherein the sliding window of time represents a larger window of time for those of the spherical harmonic coefficients having an lower order and a relatively smaller window of time for those of the spherical harmonic coefficients having a higher order.

Clause 27D

The device of clause 21D, wherein the spherical harmonic coefficients include at least one spherical harmonic coefficient having an order greater than one.

Clause 28D

The device of clause 21D, further comprising means for performing an energy analysis with respect to the spherical harmonic coefficients to determine at least one energy volume.

Clause 29D

The device of clause 28D, wherein the means for applying the at least one threshold comprises:

means for multiplying the at least one energy volume associated with those of the spherical harmonic coefficients having an order greater than one by the dynamically determined at least one threshold to determine at least one comparison energy volume;

means for determining whether the at least one comparison energy volume is greater than the at least one energy volume associated with the one of the spherical harmonic coefficients having an order equal to zero; and means for eliminating one or more of the spherical harmonic coefficients having an order greater than one based on the determination.

Clause 30D

The device of clause 21D, wherein the reduced set of the spherical harmonic coefficients does not include at least one of the spherical harmonic coefficients present in the samples of the spherical harmonic coefficients.

Clause 31D

A non-transitory computer-readable storage medium having stored thereon instructions that, when executed, cause one or more processors to:

apply at least one threshold to spherical harmonic coefficients so as to generate a reduced set of the spherical harmonic coefficients, wherein the at least one threshold is dynamically determined based on a diffusion analysis of the spherical harmonic coefficients.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various embodiments of the techniques have been described. These and other aspects of the techniques are within the scope of the following claims.

The invention claimed is:

1. A method of compressing multi-channel audio data comprising:

performing, by an audio encoder, an energy analysis with respect to each combination of an order and a sub-order to which a plurality of spherical harmonic coefficients representative of the multi-channel audio data correspond to determine an energy volume corresponding to each combination of the order and sub-order, wherein at least one of the plurality of spherical harmonic coefficients has an order greater than one;

dynamically determining, by the audio encoder, a threshold for each of the combinations of the order and the sub-order to which the plurality of spherical harmonic coefficients correspond;

applying, by the audio encoder, the dynamically determined thresholds to the corresponding energy volumes for each combination of the order and the sub-order to determine whether to eliminate the corresponding combination of the order and the sub-order to which the plurality of spherical harmonic coefficients correspond;

eliminating, by the audio encoder, the plurality of spherical harmonic coefficients based on the determination of whether to eliminate the corresponding combination of the order and the sub-order to generate a reduced version of the plurality of spherical harmonic coefficients; and generating, by the audio encoder, a bitstream based on the reduced version of the plurality of spherical harmonic coefficients.

2. The method of claim 1, wherein dynamically determining the thresholds for each of the combinations of the order and the sub-order comprises dynamically determining the thresholds for each of the combinations of the order and the sub-order based on a diffusion analysis of the plurality of spherical harmonic coefficients having an order equal to zero and an order equal to one.

3. The method of claim 1, wherein dynamically determining the at least one threshold comprises dynamically determining the at least one threshold on a per sub-order basis for the plurality of spherical harmonic coefficients.

4. The method of claim 1, wherein dynamically determining the at least one threshold comprises dynamically determining the at least one threshold on an order and a sub-order basis for the plurality of spherical harmonic coefficients.

5. The method of claim 1, further comprising transforming the plurality of spherical harmonic coefficients from a time domain to a frequency domain to generate a transformed plurality of spherical harmonic coefficients, wherein dynamically determining the thresholds for each of the combinations of the order and the sub-order comprises dynamically determining the thresholds for each of the combinations of the order and the sub-order on a per frequency bin basis for the transformed plurality of spherical harmonic coefficients.

6. The method of claim 1, further comprising, prior to performing the energy analysis and applying the dynamically determined thresholds for each of the combinations of the order and the sub-order, transforming the plurality of spherical harmonic coefficients from a time domain to a frequency domain to generate a transformed plurality of spherical harmonic coefficients.

7. The method of claim 1, further comprising applying a smoothing function to the energy volumes to generate smoothed energy volumes, wherein applying the dynamically determined thresholds for each of the combinations of the order and the sub-order comprises applying the dynamically determined thresholds for each of the combinations of the order and the sub-order to the smoothed energy volumes.

8. The method of claim 1, further comprising generating a bitmask to identify the ones of the plurality of spherical harmonic coefficients included and eliminated from the reduced version of the plurality of spherical harmonic coefficients.

9. The method of claim 1, further comprising generating a bitmask to identify the ones of the plurality of spherical harmonic coefficients included and eliminated from the reduced version of the plurality of spherical harmonic coefficients, wherein generating the bitstream further comprises generating the bitstream to include the bitmask.

10. The method of claim 1, further comprising audio encoding the reduced version of the plurality of spherical harmonic coefficients in accordance with an audio encoding scheme to generate encoded audio data, wherein generating the bitstream further comprises generating the bitstream to include the encoded audio data.

11. The method of claim 1, further comprising applying a fading function to the plurality of spherical harmonic coefficients when generating the reduced version of the plurality of spherical harmonic coefficients.

12. A device comprising:

a memory configured to store a plurality of spherical harmonic coefficients; and one or more processors of an audio encoder configured to perform an energy analysis with respect to the plurality of spherical harmonic coefficients to determine at least one energy volume, wherein at least one of the plurality of spherical harmonic coefficients has an order greater than one, dynamically determine at least one threshold based on a diffusion analysis of at least those of the plurality of spherical harmonic coefficients having an order equal to zero and an order equal to one, apply the dynamically determined at least one threshold to the at least one energy volume to generate a reduced version of the plurality of spherical harmonic coefficients, and generate, using the audio encoder, a bitstream based on the reduced version of the plurality of spherical harmonic coefficients.

13. The device of claim 12, wherein the one or more processors are further configured to dynamically determine the at least one threshold on one or more of a per order basis and a per sub-order basis for the plurality of spherical harmonic coefficients.

14. The device of claim 12, wherein the one or more processors are further configured to dynamically determine the at least one threshold on an order and a sub-order basis for the plurality of spherical harmonic coefficients.

15. The device of claim 12, wherein the one or more processors are further configured to transform the plurality of spherical harmonic coefficients from a time domain to a frequency domain to generate a transformed plurality of spherical harmonic coefficients, and wherein the one or more processors are configured to dynamically determine the at least one threshold based on the diffusion analysis and on a per frequency bin basis for the transformed plurality of spherical harmonic coefficients.

16. The device of claim 12, wherein the one or more processors are further configured to transform the plurality of spherical harmonic coefficients from a time domain to a frequency domain to generate a transformed plurality of spherical harmonic coefficients, and wherein the one or more processors are configured to apply the dynamically determined at least one threshold to the at least one energy volume to generate a reduced version of the transformed plurality of spherical harmonic coefficients having at least one of the spherical harmonic coefficients eliminated from the transformed plurality of spherical harmonic coefficients.

17. The device of claim 12, wherein the one or more processors are configured to perform the energy analysis with respect to those of the plurality of spherical harmonic coefficients having an order equal to zero to determine a zero-order energy volume, and perform the energy analysis with respect to those of the plurality of spherical harmonic coefficients having an order greater than zero to determine non-zero-order energy volumes.

18. The device of claim 12, wherein the one or more processors are configured to perform the energy analysis with respect to each combination of an order and a sub-order to which the plurality of spherical harmonic coefficients correspond to generate an energy volume corresponding to each combination of the order and the sub-order, and wherein the one or more processors are configured to apply the at least one threshold to the energy volumes corresponding to each combination of the order and the sub-order to determine whether to eliminate the corresponding combination of the order and the sub-order of the plurality of spherical harmonic coefficients, and eliminate those of the plurality of the spherical harmonic coefficients corresponding to the combination of the order and the sub-order based on the determinations to generate the reduced version to the plurality of the spherical harmonic coefficients.

19. The device of claim 12, wherein the one or more processors are configured to multiply the at least one energy volume associated with those of the plurality of spherical harmonic coefficients having an order greater than one by the dynamically determined at least one threshold to determine at least one comparison energy volume, determine whether the at least one comparison energy volume is greater than the at least one energy volume associated with the one of the plurality of spherical harmonic coefficients having an order equal to zero, and eliminate one or more of the plurality of spherical harmonic coefficients having an order greater than one based on the determination.

20. A device for compressing multi-channel audio data comprising:

means for storing a plurality of spherical harmonic coefficients representative of the multi-channel audio data; and means for performing an energy analysis with respect to each combination of an order and a sub-order to which the plurality of spherical harmonic coefficients correspond to determine an energy volume corresponding to each combination of the order and sub-order, wherein at least one of the plurality of spherical harmonic coefficients has an order greater than one;

means for dynamically determining a threshold for each of the combinations of the order and the sub-order to which the plurality of spherical harmonic coefficients correspond;

means for applying the dynamically determined thresholds to the corresponding energy volumes for each combination of the order and the sub-order to determine whether to eliminate the corresponding combination of the order and the sub-order to which the plurality of spherical harmonic coefficients correspond;

means for eliminating the plurality of spherical harmonic coefficients based on the determination of whether to eliminate the corresponding combination of the order and the sub-order to generate a reduced version of the plurality of spherical harmonic coefficients; and means for generating a bitstream based on the reduced version of the plurality of spherical harmonic coefficients.

21. A non-transitory computer-readable storage medium having stored thereon instructions that, when executed, cause one or more processors of an audio encoder to:

perform an energy analysis with respect to each combination of an order and a sub-order to which a plurality of spherical harmonic coefficients representative of the multi-channel audio data correspond to determine an energy volume corresponding to each combination of the order and sub-order, wherein at least one of the plurality of spherical harmonic coefficients has an order greater than one:

dynamically determine a threshold for each of the combinations of the order and the sub-order to which the plurality of spherical harmonic coefficients correspond based at least in part on a diffusion analysis;

apply the dynamically determined thresholds to the corresponding energy volumes for each combination of the order and the sub-order to determine whether to eliminate the corresponding combination of the order and the sub-order to which the plurality of spherical harmonic coefficients correspond;

eliminate the plurality of spherical harmonic coefficients based on the determination of whether to eliminate the corresponding combination of the order and the sub-order to generate a reduced version of the plurality of spherical harmonic coefficients; and generate, using the audio encoder, a bitstream based on the reduced version of the plurality of spherical harmonic coefficients.

* * * * *